US011640133B2

(12) United States Patent
Mimura et al.

(10) Patent No.: US 11,640,133 B2
(45) Date of Patent: May 2, 2023

(54) IMAGE FORMING APPARATUS CAPABLE OF CALCULATING DETERIORATION QUANTITY OF PHOTOSENSITIVE DRUM BASED ON THE NUMBER OF ROTATIONS IN CONTACT AND SEPARATION STATES

(71) Applicant: BROTHER KOGYO KABUSHIKI KAISHA, Nagoya (JP)

(72) Inventors: Chieko Mimura, Nagoya (JP); Yusuke Ikegami, Nagoya (JP); Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/460,411

(22) Filed: Aug. 30, 2021

(65) Prior Publication Data

US 2022/0082975 A1 Mar. 17, 2022

(30) Foreign Application Priority Data

Sep. 14, 2020 (JP) ..... JP2020-153549
Sep. 14, 2020 (JP) ..... JP2020-153550

(51) Int. Cl.
*G03G 21/16* (2006.01)
*G03G 15/00* (2006.01)
*G03G 21/18* (2006.01)

(52) U.S. Cl.
CPC ..... *G03G 15/553* (2013.01); *G03G 15/751* (2013.01); *G03G 15/757* (2013.01); *G03G 21/1857* (2013.01); *G03G 2221/183* (2013.01)

(58) Field of Classification Search
None
See application file for complete search history.

(56) References Cited

U.S. PATENT DOCUMENTS

2007/0122167 A1 5/2007 Sugiyama et al.
2014/0016953 A1* 1/2014 Yoshida ..... G03G 15/5033 399/26

FOREIGN PATENT DOCUMENTS

JP 9-244413 A 9/1997
JP 10-161485 A 6/1998
JP 2003-323090 A 11/2003
JP 2005-128150 A 5/2005
JP 2006-084828 A 3/2006
(Continued)

*Primary Examiner* — Sevan A Aydin
(74) *Attorney, Agent, or Firm* — Merchant & Gould P.C.

(57) ABSTRACT

An image forming apparatus includes: a photosensitive drum; a developing roller; a separation mechanism configured to switch a state of the photosensitive drum and the developing roller between a contact state and a separation state; a main memory storing therein a first rotation number and a second rotation number; and a controller configured to perform calculating a deterioration quantity of the photosensitive drum based on the first rotation number and the second rotation number in the main memory. A surface of the developing roller contacts a surface of the photosensitive drum in the contact state, whereas the surface of the developing roller is separated from the surface of the photosensitive drum in the separation state. The first rotation number is the number of rotations of the photosensitive drum in the contact state, and the second rotation number is the number of rotations of the photosensitive drum in the separation state.

29 Claims, 18 Drawing Sheets

(56) References Cited

FOREIGN PATENT DOCUMENTS

| | | | |
|---|---|---|---|
| JP | 2007-155756 | A | 6/2007 |
| JP | 2007-187734 | A | 7/2007 |
| JP | 2008-508555 | A | 3/2008 |
| JP | 2013-050601 | A | 3/2013 |
| WO | 2006/020007 | A1 | 2/2006 |

* cited by examiner

FIG. 11

| | CONTACT STATE | SEPARATION STATE |
|---|---|---|
| HIGH TEMPERATURE | $a_H$ | $b_H$ |
| MEDIUM TEMPERATURE | $a_M$ | $b_M$ |
| LOW TEMPERATURE | $a_L$ | $b_L$ |

FIG. 12

| 98A | | 98B | |
|---|---|---|---|
| FIRST STORAGE AREA | | SECOND STORAGE AREA | |
| $x_1$ | $a_1$ | $y_1$ | $b_1$ |
| $x_2$ | $a_2$ | $y_2$ | $b_2$ |
| $x_3$ | $a_3$ | $y_3$ | $b_3$ |
| ⋮ | ⋮ | ⋮ | ⋮ |
| $x_m$ | $a_m$ | $y_n$ | $b_n$ |
| ⋮ | ⋮ | ⋮ | ⋮ |

FIG. 15

CONTACT STATE

| Z | HIGH TEMPERATURE | MEDIUM TEMPERATURE | LOW TEMPERATURE |
|---|---|---|---|
| NEW – LOW | $a_{HS}$ | $a_{MS}$ | $a_{LS}$ |
| MEDIUM | $a_{HF}$ | $a_{MF}$ | $a_{LF}$ |
| HIGH – END OF SERVICE LIFE | $a_{HO}$ | $a_{MO}$ | $a_{LO}$ |

SEPARATION STATE

| Z | HIGH TEMPERATURE | MEDIUM TEMPERATURE | LOW TEMPERATURE |
|---|---|---|---|
| NEW – LOW | $b_{HS}$ | $b_{MS}$ | $b_{LS}$ |
| MEDIUM | $b_{HF}$ | $b_{MF}$ | $b_{LF}$ |
| HIGH – END OF SERVICE LIFE | $b_{HO}$ | $b_{MO}$ | $b_{LO}$ |

IMAGE FORMING APPARATUS CAPABLE OF CALCULATING DETERIORATION QUANTITY OF PHOTOSENSITIVE DRUM BASED ON THE NUMBER OF ROTATIONS IN CONTACT AND SEPARATION STATES

CROSS REFERENCE TO RELATED APPLICATION

This application claims priorities from Japanese Patent Application Nos. 2020-153549 filed Sep. 14, 2020 and 2020-153550 filed Sep. 14, 2020. The entire contents of the priority applications are incorporated herein by reference.

TECHNICAL FIELD

The present disclosure relates to a drum cartridge including a photosensitive drum and a developing roller movable away from the photosensitive drum, and an image forming apparatus including the drum cartridge.

BACKGROUND

There has been known an image forming apparatus including a drum cartridge in which a developing roller is movable to separate from a photosensitive drum. In such an image forming apparatus, a period of time during which the developing roller makes contact with the photosensitive drum at the time of image forming operation is counted. When a total period of time during which the developing roller makes contact with the photosensitive drum reaches a threshold value, it is determined that the photosensitive drum reaches its end of service life.

SUMMARY

However, the conventional image forming apparatus may not perform accurate calculation of a deterioration quantity of the photosensitive drum, since a deterioration quantity of the photosensitive drum when the developing roller is in separation from the photosensitive drum is not taken into consideration in the above technique.

In view of the foregoing, it is an object of the present disclosure to provide a drum cartridge and an image forming apparatus in which accurate calculation of deterioration quantity of a photosensitive drum can be performed.

In order to attain the above and other objects, according to one aspect, the present disclosure provides an image forming apparatus including: a photosensitive drum; a developing roller; a separation mechanism; a main memory; and a controller. The photosensitive drum is rotatable about a first axis extending in an axial direction. The developing roller is rotatable about a second axis extending in the axial direction. The separation mechanism is configured to move at least one of the photosensitive drum and the developing roller to switch a state of the photosensitive drum and the developing roller between: a contact state in which an outer circumferential surface of the developing roller is in contact with an outer circumferential surface of the photosensitive drum; and a separation state in which the outer circumferential surface of the developing roller is in separation from the outer circumferential surface of the photosensitive drum. The main memory is configured to store therein a first rotation number and a second rotation number. The first rotation number is the number of rotations of the photosensitive drum in the contact state of the photosensitive drum and the developing roller. The second rotation number is the number of rotations of the photosensitive drum in the separation state of the photosensitive drum and the developing roller. The controller is configured to perform: calculating a deterioration quantity of the photosensitive drum based on the first rotation number and the second rotation number those stored in the main memory.

According to another aspect, the present disclosure also provides a drum cartridge including: a photosensitive drum; and a drum memory. The photosensitive drum is rotatable about a first axis extending in an axial direction. The photosensitive drum is switchable between: a contact state in which an outer circumferential surface of the photosensitive drum is in contact with an outer circumferential surface of a developing roller; and a separation state in which the outer circumferential surface of the photosensitive drum is in separation from the outer circumferential surface of the developing roller. The drum memory includes: a first storage area; and a second storage area. The first storage area is configured to store therein a first rotation number which is the number of rotations of the photosensitive drum in the contact state of the photosensitive drum. The second storage area is configured to store therein a second rotation number which is the number of rotations of the photosensitive drum in the separation state of the photosensitive drum.

According to still another aspect, the present disclosure also provides a drum cartridge including: a photosensitive drum; and a drum memory. The photosensitive drum is rotatable about a first axis extending in an axial direction. The photosensitive drum is switchable between: a contact state in which an outer circumferential surface of the photosensitive drum is in contact with an outer circumferential surface of a developing roller; and a separation state in which the outer circumferential surface of the photosensitive drum is in separation from the outer circumferential surface of the developing roller. The drum memory is configured to store therein a deterioration quantity of the photosensitive drum which is deteriorated due to rotation of the photosensitive drum. The deterioration quantity is determined based on a first rotation number and a second rotation number. The first rotation number is the number of rotations of the photosensitive drum in the contact state of the photosensitive drum. The second rotation number is the number of rotations of the photosensitive drum in the photosensitive drum.

BRIEF DESCRIPTION OF THE DRAWINGS

The particular features and advantages of the embodiment(s) as well as other objects will become apparent from the following description taken in connection with the accompanying drawings, in which:

FIG. 11 is a coefficient map according to a state of a photosensitive drum in an image forming apparatus according to a second embodiment;

FIG. 12 is a table indicating information stored in a first storage area and a second storage region in a drum memory in the image forming apparatus according to the second embodiment and a third embodiment of the present disclosure;

FIG. 15 is a coefficient map according to a state of a photosensitive drum in the image forming apparatus according to the third embodiment;

DETAILED DESCRIPTION

First Embodiment

Hereinafter, an image forming apparatus 1 according to a first embodiment of the present disclosure will be described with reference to FIGS. 1 through 10.

Figure 1:
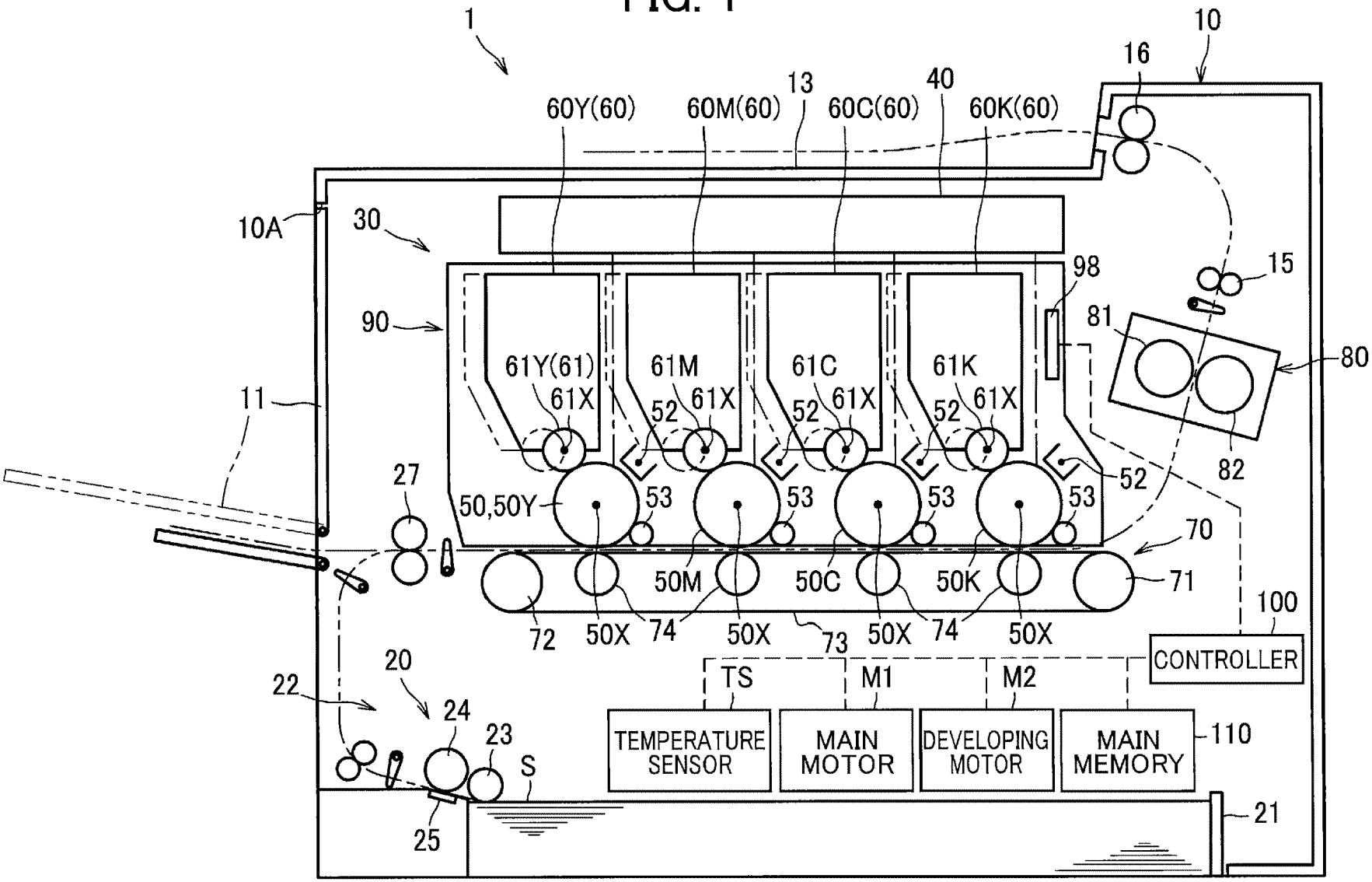
FIG. 1 is a diagram schematically illustrating a configuration of an image forming apparatus according to a first embodiment of the present disclosure.

As illustrated in FIG. 1, the image forming apparatus 1 is a color printer and includes a main casing 10, a cover 11, a sheet supply unit 20, an image forming unit 30, a controller 100, a main memory 110, a temperature sensor TS, a main motor M1, and a developing motor M2.

The main casing 10 has a first opening 10A. The cover 11 is pivotally movable between a closed position (a position indicated by a solid line) in which the cover 11 closes the first opening 10A and an open position (a position indicated by a two-dotted chain line) in which the cover 11 opens the first opening 10A.

The sheet supply unit 20 is positioned at a lower internal portion of the main casing 10. The sheet supply unit 20 includes a sheet tray 21 configured to accommodate therein a sheet(s) S, and a sheet supply mechanism 22 configured to supply a sheet S from the sheet tray 21 to the image forming unit 30. The sheet tray 21 is detachable from the main casing 10 by pulling the sheet tray 21 out of the main casing 10.

The sheet supply mechanism 22 includes a sheet pick-up roller 23, a separation roller 24, a separation pad 25, and a pair of registration rollers 27. The sheet S is a medium on which the image forming apparatus 1 can form an image. For example, plain paper, an envelope, a post card, thin paper, thick paper, calendered paper, a resin sheet, and a seal are available as the sheet S.

In the sheet supply unit 20, the sheet(s) S accommodated in the sheet tray 21 is fed by the sheet pick-up roller 23, and then separated one by one by the separation roller 24 and the separation pad 25. Thereafter, a position of a leading edge of the sheet S is regulated by the registration rollers 27 whose rotation is stopped, and then, the sheet S is supplied to the image forming unit 30 by rotation of the registration rollers 27.

The image forming unit 30 includes an exposure unit 40, a drawer 90 as an example of a drum cartridge, a plurality of developing cartridges 60, a conveying unit 70, and a fixing unit 80.

The exposure unit 40 includes a laser diode, a deflector, lenses, and mirrors those are not illustrated. The exposure unit 40 is configured to emit a plurality of laser beams which expose surfaces of respective photosensitive drums 50 to scan the surfaces.

The drawer 90 includes the plurality of photosensitive drums 50, the plurality of developing cartridges 60, and a drum memory 98. That is, the drawer 90 is for use with the developing cartridges 60. The developing cartridges 60 are attachable to and detachable from the drawer 90.

Each of the photosensitive drums 50 is rotatable about a first axis 50X extending in an axial direction of the photosensitive drum 50. In the following description, the axial direction of the photosensitive drum 50 will be simply referred to as "axial direction". A rotational driving force of the main motor M1 is inputted into the photosensitive drums 50.

The photosensitive drums 50 include a photosensitive drum 50Y for a color of yellow, a photosensitive drum 50M for a color of magenta, a photosensitive drum 50C for a color of cyan, and a photosensitive drum 50K for a color of black. Throughout the specification and the drawings, in a case where colors must be specified, members or components corresponding to the colors of yellow, magenta, cyan and black are designated by adding "Y", "M", "C" and "K", respectively.

Each of the developing cartridges 60 includes a developing roller 61. Each of the developing rollers 61 is configured to supply toner to a corresponding one of the photosensitive drums 50. Specifically, the developing cartridges 60 include developing cartridges 60Y, 60M, 60C and 60K respectively including developing rollers 61Y, 61M, 61C and 61K. Also, these developing rollers 61Y, 61M, 61C and 61K correspond to the photosensitive drums 50Y, 50M, 50C and 50K, respectively, for the colors of yellow, magenta, cyan and black.

The temperature sensor TS is a sensor positioned inside the main casing 10 and at a position adjacent to the photosensitive drums 50. The temperature sensor TS is configured to detect a temperature inside the main casing 10 of the image forming apparatus 1. In the present embodiment, a temperature detected by the temperature sensor TS is regarded as a temperature of the photosensitive drums 50.

The developing roller 61Y, the developing roller 61M, the developing roller 61C, and the developing roller 61K are arranged in this order from the upstream side toward the downstream side in a moving direction of the sheet S (hereinafter simply referred to as "sheet moving direction"). Each of the developing rollers 61 is rotatable about a second axis 61X extending in the axial direction.

Each of the developing cartridges 60 is movable between a contact position (a position indicated by the solid line in FIG. 1) where the developing roller 61 is in contact with the corresponding photosensitive drum 50 and a separated position (a position indicated by the two-dotted chain line in FIG. 1) where the developing roller 61 is in separation from the corresponding photosensitive drum 50. When the developing cartridge 60 is in the contact position, the developing roller 61 and the corresponding photosensitive drum 50 are in a contact state. When the developing cartridge 60 is in the separated position, the developing roller 61 and the corresponding photosensitive drum 50 are in a separation state.

Figure 2:
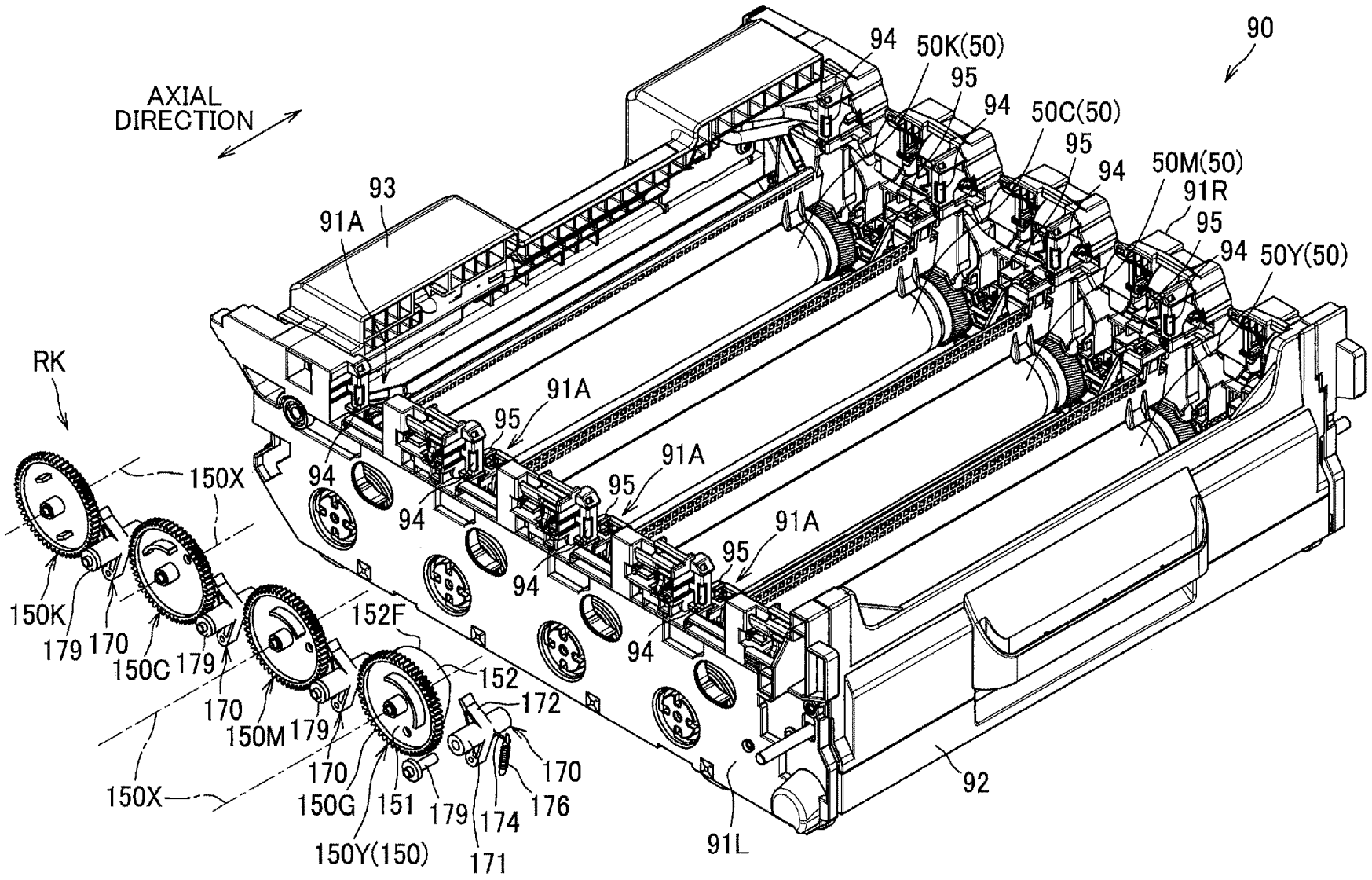
FIG. 2 is an exploded perspective view of a drawer and a separation mechanism of the drawer in the image forming apparatus according to the first embodiment.

As illustrated in FIG. 2, the photosensitive drums 50 are rotatably supported by the drawer 90. Further, the developing cartridges 60 are supported by the drawer 90 so as to be attachable to and detachable from the drawer 90. Moreover, the drawer 90 is attachable to and detachable from the main casing 10 through the first opening 10A by opening the cover 11 (see FIG. 1). As described above, the drawer 90 can be pulled out of the main casing 10 in the present embodiment.

The drawer 90 also includes a side frame 91R, a side frame 91L, a connection frame 92, and a connection frame 93. The side frame 91R and the side frame 91L are spaced apart from each other in the axial direction. The connection frame 92 connects one end portion of the side frame 91R to one end portion of the side frame 91L, and the connection frame 93 connects another end portion of the side frame 91R to another end portion of the side frame 91L.

The drawer 90 further includes chargers 52 and cleaning rollers 53 as illustrated in FIG. 1. Each of the chargers 52 is positioned to face the corresponding one of the photosensitive drums 50 and configured to charge the same. Each of the cleaning roller 53 is in contact with the corresponding one of the photosensitive drums 50 and configured to clean the photosensitive drum 50.

Although not illustrated in the drawings in detail, the side frames 91R and 91L support one end portions and another end portions of the photosensitive drums 50. Further, the side frame 91L has a plurality of second openings 91A. Each of the second openings 91A is in a form of a notch recessed downward from an upper edge of the side frame 91L and penetrates the side frame 91L in the axial direction. With this configuration, each of the second opening 91A allows the corresponding one of cam followers 170 (described later) to be positioned therein.

The image forming apparatus 1 further includes a plurality of separation mechanisms RK (see FIG. 2). Each of the separation mechanism RK is configured to switch a state of the corresponding photosensitive drum 50 and the developing roller 61 between the contact position where an outer circumferential surface of the developing roller 61 is in contact with an outer circumferential surface of the corresponding photosensitive drum 50 and the separation state where the outer circumferential surface of the developing roller 61 is in separation from the outer circumferential surface of the corresponding photosensitive drum 50.

Each of the separation mechanisms RK is configured to switch the state of the corresponding photosensitive drum 50 and the developing roller 61 between the contact state and the separation state by moving at least one of the corresponding photosensitive drum 50 and the developing roller 61.

In the present embodiment, each of the separation mechanism RK is configured to move the corresponding developing roller 61 between the contact position where the developing roller 61 is in contact with the corresponding photosensitive drum 50 and the separated position where the developing roller 61 is in separation from the corresponding photosensitive drum 50. These separation mechanisms RK are provided for the colors of Y, M, C and K.

Specifically, each of the separation mechanisms RK includes a support shaft 179, a cam gear 150 (150Y, 150M, 150C and 150K), the cam follower 170, a slide member 64, and a spring 176 as illustrated in FIGS. 2 to 4.

The support shaft 179 is a shaft that extends in the axial direction. The support shaft 179 is provided at a side frame (not illustrated) of the main casing 10.

The cam gear 150 is rotatable about a rotation axis 150X extending in parallel to the second axis 61X (see FIG. 1) of the developing roller 61. The cam gear 150 includes a gear portion 150G, a disc portion 151, and an end cam 152.

The gear portion 150G is positioned at an outer periphery of the disc portion 151. The gear portion 150G is configured to receive a driving force from the developing motor M2. The disc portion 151 has a substantially circular-plate shape, and a rotational driving force is inputted from the developing motor M2 to the gear portion 150G. Accordingly, the separation mechanism RK is operated by the driving force of the developing motor M2.

The cam follower 170 is slidingly movably supported by the support shaft 179, and is slidingly movable in the axial direction due to contact with the end cam 152. Specifically, as the cam gear 150 rotates, the cam follower 170 is guided by the end cam 152 to be slidingly movable between a first position (a position illustrated in FIG. 4B) and a second position (a position illustrated in FIG. 4A). The developing roller 61 and the photosensitive drum 50 are in the separation state when the cam follower 170 is at the first position, whereas the developing roller 61 and the photosensitive drum 50 are in the contact state when the cam follower 170 is at the second position. The cam follower 170 includes a slide shaft portion 171, a contacting portion 172, and a spring hook portion 174.

The spring 176 illustrated in FIG. 2 is a tension spring. The spring 176 has one end portion engaging with the spring hook portion 174, and has another end portion engaging with the drawer 90 at a position lower than the spring hook portion 174. Hence, the spring 176 urges the cam follower 170 in a direction from the first position toward the second position. As such, the spring 176 constantly urges the cam follower 170 toward the end cam 152.

The slide shaft portion 171 engages with the support shaft 179. The contacting portion 172 extends from the slide shaft portion 171. The contacting portion 172 has an end face in the axial direction facing the end cam 152 and contactable with the end cam 152.

As illustrated in FIG. 3, the slide member 64 is a member slidingly movable in the axial direction relative to a casing 63 of the developing cartridge 60. That is, the slide member 64 is pressed by the cam follower 170 to be slidingly movable in the axial direction.

Figures 4A, 4B:
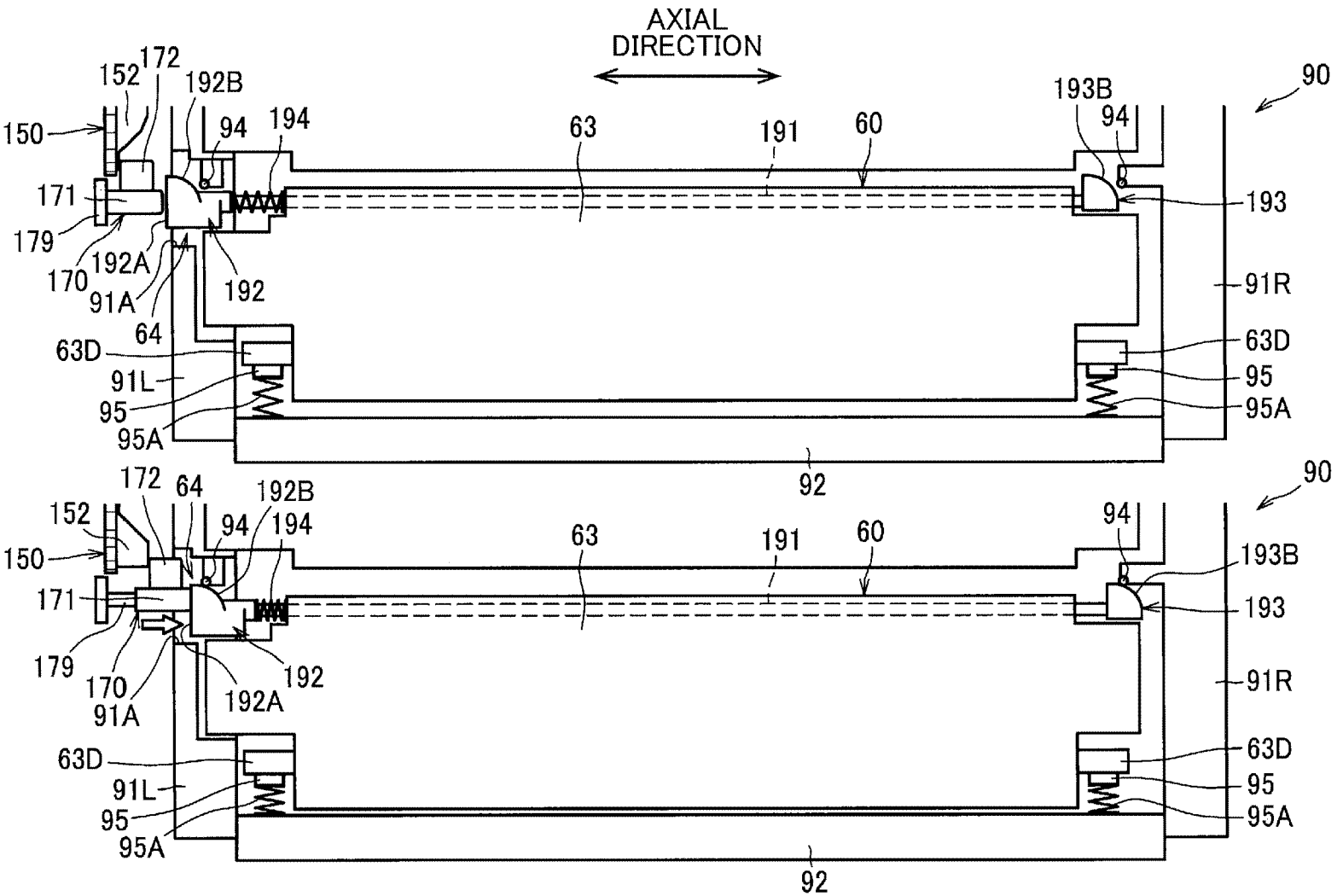
FIG. 4A is a schematic top view illustrating the developing cartridge and components in the vicinity thereof in the image forming apparatus according to the first embodiment, and particularly illustrating a state where a developing roller is in its contact state.
FIG. 4B is a schematic top view illustrating the developing cartridge and the components in the vicinity thereof in the image forming apparatus according to the first embodiment, and particularly illustrating a state where the developing roller is in its separation state.

As illustrated in FIGS. 4A and 4B, the slide member 64 includes a shaft 191, a first abutment member 192 fixed to one end of the shaft 191, and a second abutment member 193 fixed to another end of the shaft 191.

The shaft 191 penetrates a hole formed in the casing 63 and extending in the axial direction, and is slidingly movably supported by the casing 63.

The first abutment member 192 has a pressure receiving surface 192A which is an end face thereof in the axial direction, and an inclined surface 192B inclined relative to the axial direction. The pressure receiving surface 192A is configured to be pressed by the cam follower 170.

When the slide member 64 is pressed in the axial direction by the cam follower 170, the inclined surface 192B is configured to abut against a corresponding one of counterpart abutment portions 94 of the drawer 90 to urge the developing cartridge 60 (60Y, 60M, 60C and 60K) in a direction parallel to the sheet moving direction, thereby moving the developing cartridge 60. The inclined surface 182B is inclined in a direction from the photosensitive drum 50 toward the corresponding developing roller 61 as extending in a direction from the one end to the other end of the shaft 191 in the axial direction.

The second abutment member 193 has an inclined surface 193B similar to the inclined surface 192B of the first abutment member 192. The inclined surface 193B is configured to abut against a corresponding one of the counterpart abutment portions 94 of the drawer 90 when the slide member 64 is pressed in the axial direction by the cam follower 170, to urge the developing cartridge 60 (60Y, 60M, 60C and 60K) in the sheet moving direction to move the same.

A spring 194 is positioned between the first abutment member 192 and the casing 63 to urge the slide member 64 toward the one side (i.e., toward the one end of the shaft 191) in the axial direction. The spring 194 is a compression spring disposed over the shaft 191 to allow the shaft 191 to be inserted therethrough. The spring 194 functions to urge the cam follower 170 toward the end cam 152 in the separation state of the developing roller 61 and the photosensitive drum 50.

The counterpart abutment portions 94 are provided on upper portions of each of the side frames 91R and 91L of the drawer 90. The counterpart abutment portions 94 are configured to abut the slide members 64. Each of the counterpart abutment portions 94 is in a form of a roller rotatable about an axis extending in a third direction (an up-down direction) perpendicular to a first direction in parallel to the axial direction and a second direction in which the photosensitive drums 50 extend, for example.

The drawer 90 further includes pressure members 95 provided for each of the developing cartridges 60. The pressure members 95 are positioned at positions in the vicinity of both end portions in the axial direction of the photosensitive drum 50, respectively, for each of the developing cartridges 60. Each of the pressure members 95 is urged by a spring 95A (see FIGS. 4A and 4B). As a result of attachment of the developing cartridge 60 to the drawer 90, the pressure members 95 presses protrusions 63D (described later) of the developing cartridge 60, respectively, due to a biasing force of the springs 95A to allow the developing roller 61 to make contact with the corresponding photosensitive drum 50.

Figure 3A:
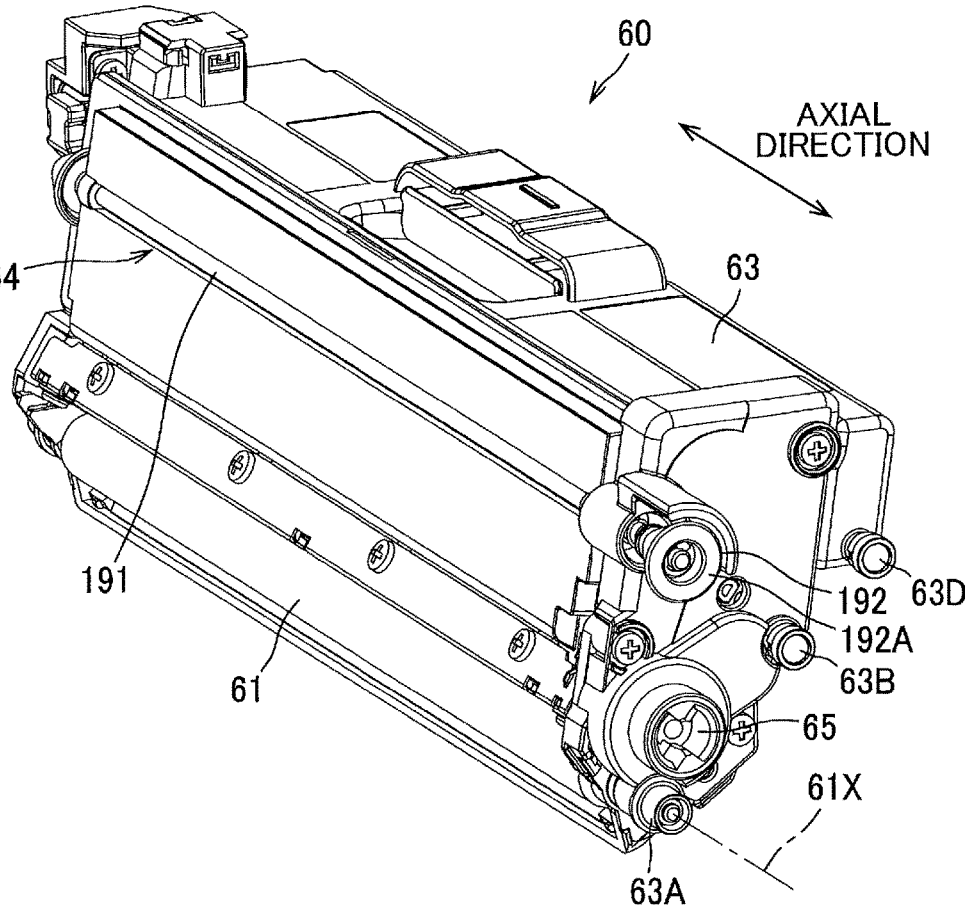
FIG. 3A is a perspective view of a developing cartridge in the image forming apparatus according to the first embodiment.
Figure 3B:
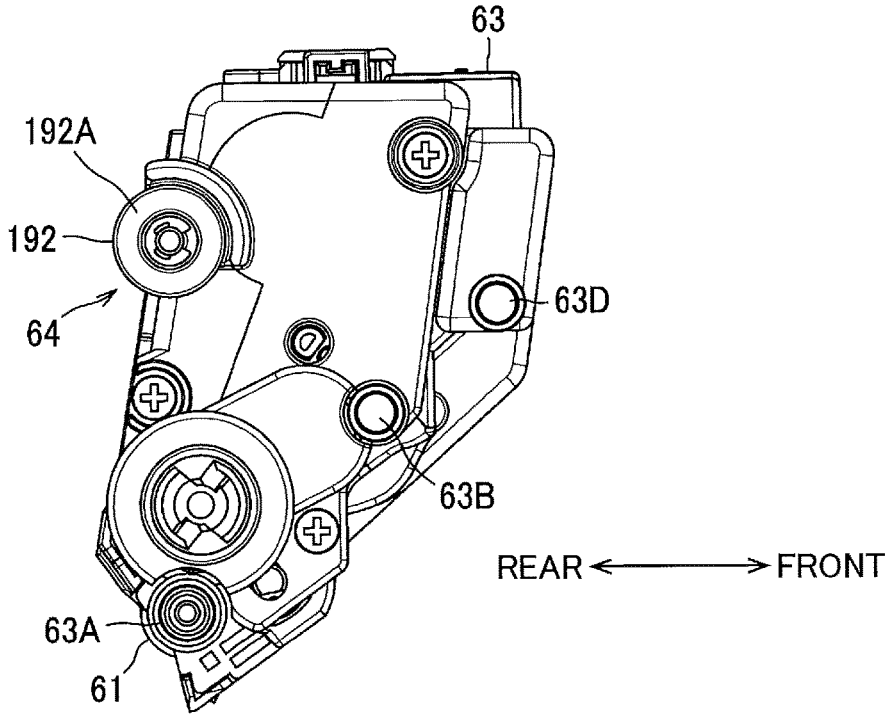
FIG. 3B is a side view of the developing cartridge in the image forming apparatus according to the embodiment.

As illustrated in FIGS. 3A and 3B, each of the developing cartridges 60 (60Y, 60M, 60C and 60K) includes the casing 63 configured to accommodate toner therein, the slide member 64, and a coupling 65.

The casing 63 has one side surface in the axial direction on which a first protruding portion 63A and a second protruding portion 63B each protruding in the axial direction. The first protruding portion 63A is coaxial with the second axis 61X of the developing roller 61 and extending in the axial direction. The second protruding portion 63B is positioned away from the first protruding portion 63A by a prescribed distance. The second protruding portion 63B is positioned above the first protruding portion 63A in the present embodiment.

The first and second protruding portions 63A and 63B are rollers rotatable about axes extending in parallel to the axial direction. Although not illustrated in the drawings, the first and second protruding portions 63A and 63B are also provided at another side surface of the casing 63 at positions symmetrical with the first and second protruding portions 63A and 63B provided at the one side surface.

Further, the above-described protrusion 63D configured to be pressed by the pressure member 95 is positioned at an upper front surface of the casing 63. The protrusion 63D protrudes in the axial direction outward from each side surface of the casing 63 in the axial direction.

The coupling 65 is configured to receive a rotational driving force of the developing motor M2. The developing roller 61 rotates in accordance with rotation of the coupling 65.

Figure 5:
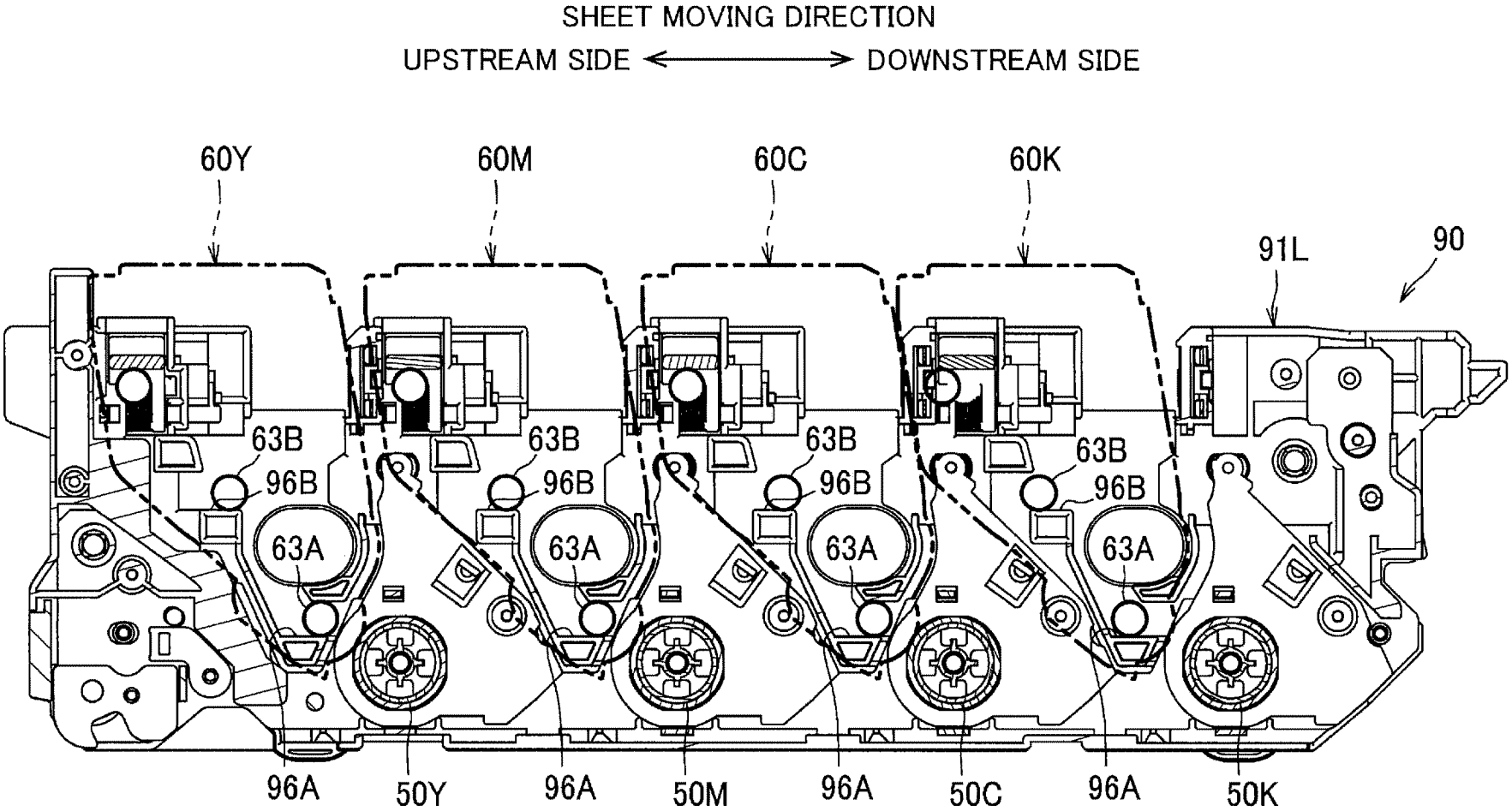
FIG. 5 is a view illustrating an inner portion of a side frame of the drawer to which the developing cartridge is attachable in the image forming apparatus according to the first embodiment.

As illustrated in FIG. 5, the side frame 91L of the drawer 90 has an inner surface having first support surfaces 96A and second support surfaces 96B. The first support surface 96A and the second support surface 96B support the first protruding portion 63A and the second protruding portion 63B of the corresponding developing cartridge 60 from below when the developing cartridge 60 (60Y, 60M, 60C and 60K) is moved from the contact position to the separated position. Each of the first support surfaces 96A and each of the second support surfaces 96B extend in the sheet moving direction.

Each of the first support surfaces 96A is positioned to support the corresponding first protruding portion 63A. The first support surface 96A is configured to guide the developing roller 61 and to fix a position thereof in the up-down direction when the developing cartridge 60 is attached to the drawer 90. Each of the second support surfaces 96B is positioned above the first support surface 96A to support the corresponding second protruding portion 63B.

Although not illustrated in the drawings, the first and second support surfaces 96A and 96B are also provided at an inner surface of the other side frame 91R of the drawer 90 at positions symmetrical with the first and second support surfaces 96A and 96B of the left side frame 91L.

Referring to FIG. 5, when the developing cartridge 60 is positioned at the contact position where the developing roller 61 is in contact with the corresponding photosensitive drum 50, the first protruding portion 63A is positioned closer to the downstream side in the sheet moving direction of the corresponding first support surface 96A (see the first protruding portions 63A of the developing cartridges 60Y, 60M and 60C). On the other hand, when the developing cartridge 60 is at the separated position in which the developing roller 61 is separated away from the corresponding photosensitive drum 50, the first protruding portion 63A is positioned closer to the upstream side in the sheet moving direction of the corresponding first support surface 96A (see the first protruding portion 63A of the fourth developing cartridge 60K).

In this way, the developing rollers 61Y, 61M, 61C and 61K of the developing cartridges 60Y, 60M, 60C and 60K move in a direction opposite the sheet moving direction (i.e., from the downstream side toward the upstream side in the sheet moving direction) when the separation mechanisms RK move the respective developing rollers 61Y, 61M, 61C and 61K from the contact positions to the separated positions.

Referring back to FIG. 1, the conveying unit 70 is positioned between the sheet tray 21 and the photosensitive drums 50. The conveying unit 70 includes a drive roller 71, a driven roller 72, an endless belt as a conveyer belt 73, and four transfer rollers 74. The conveyer belt 73 is looped over the drive roller 71 and the driven roller 72 with taut, and has an outer peripheral surface facing each of the photosensitive drums 50. Each of the transfer rollers 74 is positioned within a loop of the conveyer belt 73 to nip the conveyer belt 73 in cooperation with a corresponding one of the photosensitive drums 50.

The conveying unit 70 conveys the sheet S as the conveyer belt 73 moves while the sheet S is mounted on an upper portion of the outer peripheral surface of the conveyer belt 73, and at the same time, toner images formed on the respective photosensitive drums 50 are transferred onto the sheet S.

The fixing unit 80 is positioned at a downstream side of the photosensitive drums 50 and the conveying unit 70 in the moving direction of the sheet S. The fixing unit 80 includes a heat roller 81 and a pressure roller 82 positioned in facing relation to the heat roller 81. A pair of conveyer rollers 15 are positioned above the fixing unit 80, and a pair of discharge rollers 16 are positioned above the conveyer rollers 15.

In the image forming unit 30 as configured above, the surface of each of the photosensitive drums 50 is uniformly charged by the corresponding charger 52, and then, the surface is exposed to light with laser beam irradiated from the exposure unit 40. Hence, an electrostatic latent image on a basis of image data is formed on the surface of each of the photosensitive drums 50.

Further, toner accommodated in each of the casings 63 is carried on the surface of the corresponding developing roller 61, and the toner is supplied from the developing roller 61 to the electrostatic latent image formed on the surface of the corresponding photosensitive drum 50 when the developing roller 61 makes contact with the photosensitive drum 50. Hence, toner image corresponding to the electrostatic latent image is formed on the surface of each photosensitive drum 50.

Then, the toner image formed on each of the photosensitive drums 50 is transferred onto the sheet S when the sheet S supplied on the conveyer belt 73 moves past a portion between the photosensitive drums 50 and the corresponding transfer rollers 74. Then, the toner image transferred onto the sheet S is thermally fixed to the sheet S as the sheet S moves past a portion between the heat roller 81 and the pressure roller 82.

The sheet S discharged from the fixing unit 80 is discharged by the conveyer rollers 15 and the discharge rollers 16 onto a discharge tray 13 positioned at an upper surface of the main casing 10.

Figure 6:
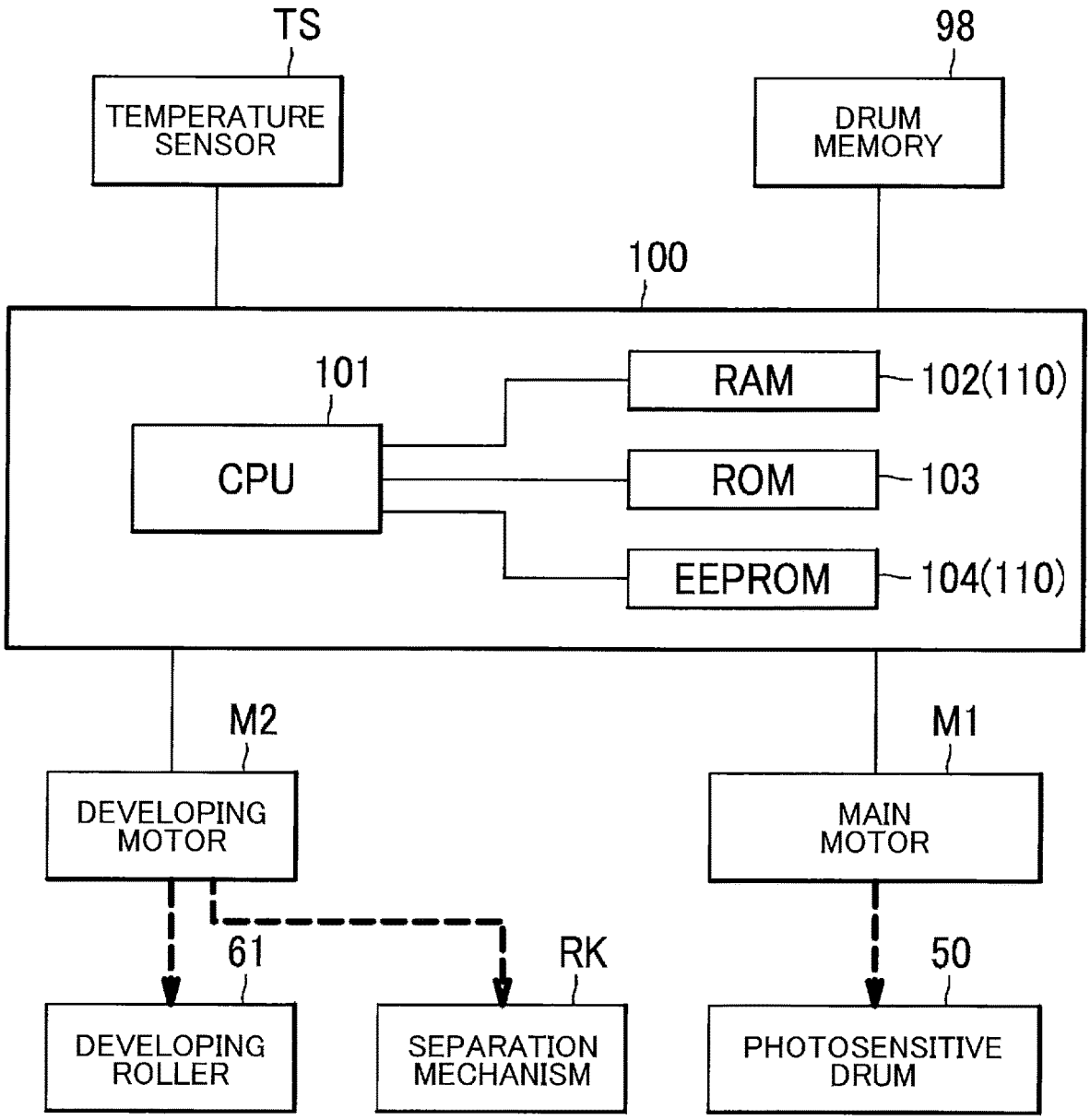
FIG. 6 is a block diagram illustrating an electrical connection among a controller, a main memory, a drum memory, a temperature sensor, and motors in the image forming apparatus according to the first embodiment.

As illustrated in FIG. 6, the controller 100 includes a CPU 101, a RAM 102, a ROM 103, an EEPROM 104, and an input/output circuit. The controller 100 is configured to perform arithmetic processing based on information about the developing cartridge 60 attached to the main casing 10, programs and data those stored in the RAM 102 and the ROM 103 to execute printing control. Incidentally, the RAM 102 and the EEPROM 104 are examples of the main memory 110. Further, the RAM 102 is an example of a volatile memory, and the EEPROM 104 is an example of a nonvolatile memory. The CPU 101 is electrically connected to the RAM 102, the ROM 103, and the EEPROM 104.

The controller 100 is electrically connected to the temperature sensor TS, the drum memory 98, the main motor M1, and the developing motor M2. The main motor M1 is configured to drive the photosensitive drums 50 through a gear train(s) (not illustrated). The developing motor M2 is configured to drive the developing rollers 61 and the separation mechanisms RK through a gear train(s) and a clutch(s) those not illustrated. Note that transmission of electrical signal is indicated by a solid line, and transmission of a driving force is indicated by a broken line in FIG. 6.

The controller 100 is configured to acquire the temperature detected by the temperature sensor TS. Further, the controller 100 is configured to read data from the drum memory 98 and to write data into the drum memory 98.

Also, the controller 100 is configured to count the number of rotations of the main motor M1, thereby calculating the number of rotations of the photosensitive drums 50 based on the counted number of rotations of the main motor M1 and a gear ratio. The gear ratio is a ratio of the number of gear teeth of an output gear of the main motor M1 to the number of gear teeth of an input gear of each photosensitive drum 50, and stored in, for example, the EEPROM 104.

Moreover, the controller 100 is configured to count the number of rotations of the developing motor M2. Accordingly, the controller 100 is configured to calculate the number of rotations the developing rollers 61 based on the counted number of rotations of the developing motor M2 and a gear ratio. Note that the gear ratio is a ratio of the number of gear teeth of an output gear of the developing motor M2 to the number of gear teeth of an input gear of each developing roller 61, and stored in, for example, the EEPROM 104.

The controller 100 is configured to count a first rotation number of the photosensitive drum 50. The first rotation number is the number of rotations of the photosensitive drum 50 when the photosensitive drum 50 and the developing roller 61 is in the contact state. Further, the controller 100 is configured to count a second rotation number of the photosensitive drum 50. The second rotation number is the number of rotations of the photosensitive drum 50 when the photosensitive drum 50 in the separation state.

Based on the first rotation number and the second rotation number, the controller 100 determines a deterioration quantity W of the photosensitive drum 50 indicative of a quantity by which the photosensitive drum 50 is deteriorated due to rotation of the photosensitive drum 50. Further, the controller 100 is configured to calculate the lifetime of the photosensitive drum 50 based on the deterioration quantity W of the photosensitive drum 50. In the following description, how the deterioration quantity W of the photosensitive drum 50, the lifetime of the photosensitive drum 50, and the remaining lifetime of the photosensitive drum 50 are calculated in the image forming apparatus 1 according to the first embodiment will be described in detail.

The controller 100 is configured to count the number of rotations of the main motor M1 for a period of time from the main motor M1 is turned ON until the main motor M1 is turned OFF. The number of rotations of the main motor M1 counted by the controller 100 is sequentially written into the RAM 102.

The controller 100 is configured to calculate the number of rotations of the photosensitive drum 50 based on the counted number of rotations of the main motor M1. The number of rotations of the photosensitive drum 50 calculated by the controller 100 is also sequentially written into the RAM 102.

The controller 100 is configured to determine whether the state between the photosensitive drum 50 and the developing roller 61 is the contact state or the separation state when the main motor M1 is turned ON to separately count the first rotation number $x_m$ and the second rotation number $y_n$ within a prescribed period of time. The first rotation number $x_m$ and the second rotation number $y_n$ are sequentially written into the RAM 102.

Figure 7:
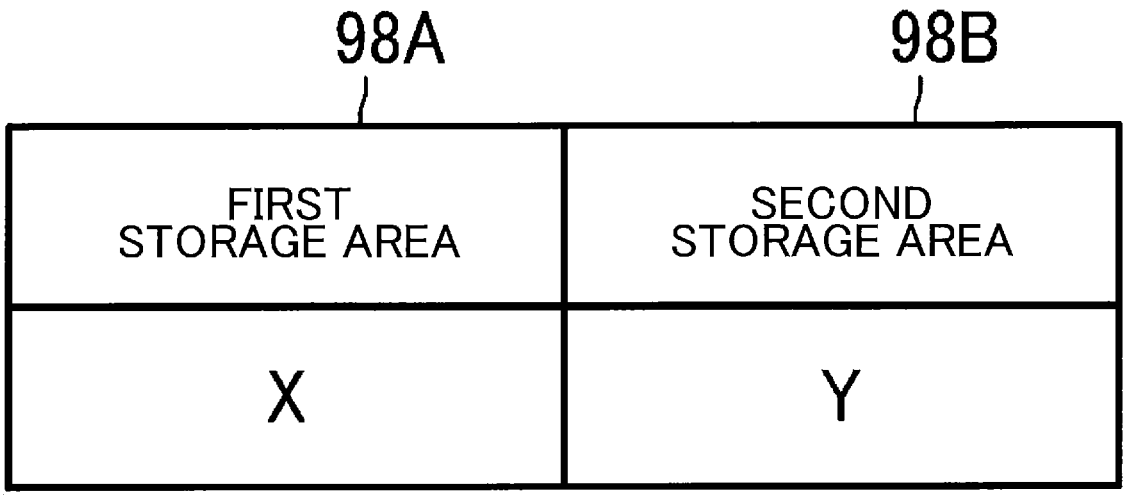
FIG. 7 is a table indicating information stored in a first storage area and a second storage area of the drum memory in the image forming apparatus according to the first embodiment.

The controller 100 stores the counted first rotation number and the counted second rotation number into the drum memory 98. As illustrated in FIG. 7, the drum memory 98 includes a first storage area 98A and a second storage area 98B.

The first storage area 98A is configured to store therein the first rotation number. In the present embodiment, the first storage area 98A stores therein a first total rotation number X as the first rotation number. The first total rotation number X is the accumulated number of rotations ($x_1+x_2+x_3+\ldots+x_m$) of the photosensitive drum 50 during the contact state since the photosensitive drum 50 is new. That is, the first total rotation number X is overwritten and stored in the first storage area 98A each time the photosensitive drum 50 in the contact state makes rotation.

The second storage area 98B is configured to store therein the second rotation number. In the present embodiment, the second storage area 98B stores therein a second total rotation number Y as the second rotation number. The second total rotation number Y is the accumulated number of rotations ($y_1+y_2+y_3+\ldots+y_n$) of the photosensitive drum 50 during the separation state since the photosensitive drum 50 is a new one. That is, the second total rotation number Y is overwritten and stored in the second storage area 98B each time the photosensitive drum 50 in the separation state rotates.

In order to calculate the deterioration quantity W of the photosensitive drum 50, the controller 100 reads the first total rotation number X and the second total rotation number Y from the drum memory 98. Then, the controller 100 calculates the deterioration quantity W of the photosensitive drum 50 based on the first total rotation number X and the second total rotation number Y those stored in the drum memory 98.

Specifically, the controller 100 adds a number obtained by multiplying the first total rotation number X by a first coefficient a to a number obtained by multiplying the second total rotation number Y by a second coefficient b to calculate the deterioration quantity W of the photosensitive drum 50. That is, $W=aX+bY$. The second coefficient b is smaller than the first coefficient a. Note that the first coefficient a and the second coefficient b are positive values obtained by experimental data prior to shipment of the image forming apparatus 1. The first coefficient a and the second coefficient b are stored in advance in the drum memory 98 or the main memory 110 (for example, the EEPROM 104).

When the deterioration quantity W of the photosensitive drum 50 reaches a threshold value, the controller 100 determines that the photosensitive drum 50 reaches the end of service life. Note that the threshold value for the determination of the service life is stored in advance in the drum memory 98 or the main memory 110 (for example, the EEPROM 104).

The controller 100 calculates the remaining service life of the photosensitive drum 50 by subtracting the deterioration quantity W of the photosensitive drum 50 from a value indicative of an entire service life (life span) of the photosensitive drum 50. The calculated remaining service life of the photosensitive drum 50 is displayed, for example, on a display (not illustrated) of the image forming apparatus 1.

Next, one example of processes performed by the controller 100 will be described with reference to a flowchart illustrated in FIG. 8. The controller 100 repeatedly performs the processes in FIG. 8 with respect to each of the four photosensitive drums 50 as long as the image forming apparatus 1 is powered ON.

Figure 8:
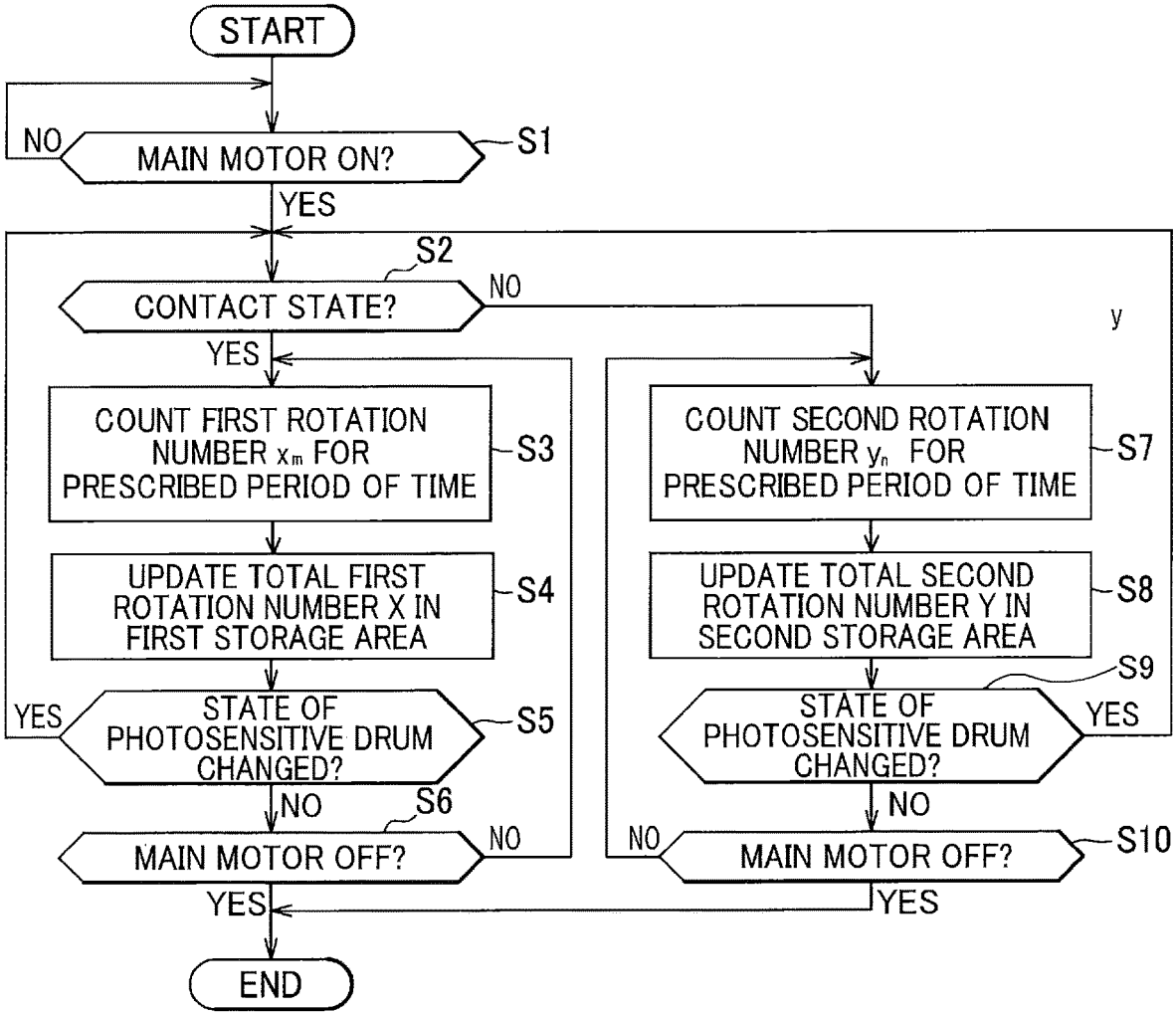
FIG. 8 is a flowchart illustrating a process for storing information into the drum memory performed by the controller in the image forming apparatus according to the first embodiment.

As illustrated in FIG. 8, in 51 the controller 100 determines whether the main motor M1 is turned ON. The controller 100 waits until the main motor M1 is turned ON when the controller 100 determines that the main motor M1 is not turned ON (S1: NO).

When the controller 100 determines that the main motor M1 is turned ON (S1: YES), in S2 the controller 100 determines whether the photosensitive drum 50 and the developing roller 61 are in the contact state.

When the controller 100 determines in S2 that the photosensitive drum 50 and the developing roller 61 are in the contact state (S2: YES), in S3 the controller 100 counts the first rotation number $x_m$ of the photosensitive drum 50 for a prescribed period of time. The first rotation number $x_m$ is sequentially written into the RAM 102. Note that the prescribe period of time may be a certain period of time, or may be a period for performing print job once, or may be a period of time for rotating the photosensitive drum 50 by the prescribed number of rotations.

After performing the process of S3, in S4 the controller 100 updates the first total rotation number X by adding the first rotation number $x_m$ counted in the prescribed period of time to the first total rotation number X stored in the first storage area 98A of the drum memory 98.

Subsequently, in S5 the controller 100 determines whether the state between the photosensitive drum 50 and the developing roller 61 (i.e., the contact state or the separation state) is changed from a state before the prescribed period of time elapses.

When the controller 100 determines in S5 that the state between the photosensitive drum 50 and the developing roller 61 is changed (S5: YES), the controller 100 shifts to the process in S2. On the other hand, when the controller 100 determines in S5 that the state between the photosensitive drum 50 and the developing roller 61 remains unchanged (S5: NO), in S6 the controller 100 determines whether to turn OFF the main motor M1.

When the controller 100 determines in S6 not to turn OFF the main motor M1 (S6: NO), the controller 100 shifts to the process in S3. On the other hand, when the controller 100 determines in S6 to turn OFF the main motor (S6: YES), the controller 100 ends the process in FIG. 8.

When the controller 100 does not determine in S2 that the photosensitive drum 50 and the developing roller 61 are in the contact state (S2: NO), i.e., the photosensitive drum 50 and the developing roller 61 are in the separation state, in S7 the controller 100 counts the second rotation number $y_n$ of the photosensitive drum 50 for the prescribed period of time.

Subsequently, in S8 the controller 100 adds the second rotation number $y_n$ counted during the prescribed period of time in S7 to the second total rotation number Y stored in the second storage area 98B of the drum memory 98 to update the second total rotation number Y.

After performing the process of S8, in S9 the controller 100 determines whether the state of the photosensitive drum 50 and the developing roller 61 is changed from a state before the prescribed period of time elapses.

When the controller 100 determines in S9 that the state of the photosensitive drum 50 and the developing roller 61 is changed (i.e., the photosensitive drum 50 and the developing roller 61 is changed from the separation state to the contact state) (S9: YES), the controller 100 shifts to S2. On the other hand, when the controller 100 determines in S9 that the state of the photosensitive drum 50 and the developing roller 61 is unchanged (S9: NO), in S10 the controller 100 determines whether the main motor M1 needs to be turned OFF.

When the controller 100 determines in S10 that ON state of the main motor M1 should be maintained (S10: NO), the controller 100 shifts to S7. On the other hand, when the controller 100 determines in S10 that the main motor M1 needs to be turned OFF (S10: YES), the controller 100 ends the process in FIG. 8.

Next, a lifetime determination process performed by the controller 100 in the image forming apparatus 1 according to the first embodiment will be described with reference to a flowchart illustrated in FIG. 9. The controller 100 repeatedly executes the lifetime determination process with respect to each of the four photosensitive drums 50 while the image forming apparatus 1 is powered ON.

Figure 9:
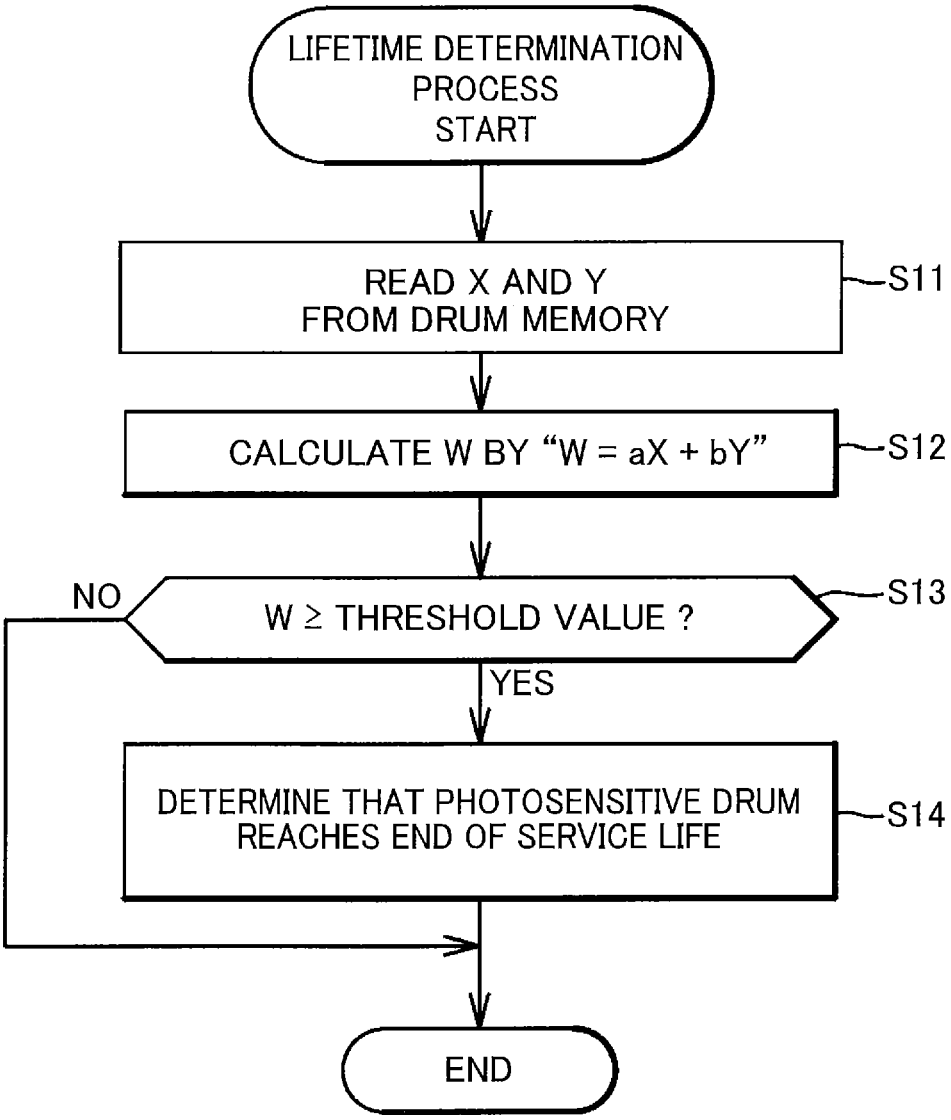
FIG. 9 is a flowchart illustrating a lifetime determination process performed by the controller in the image forming apparatus according to the first embodiment.

As illustrated in FIG. 9, when performing the lifetime determination process, in S11 the controller 100 reads the first total rotation number X and the second total rotation number Y from the drum memory 98 and stores the first total rotation number X and the second total rotation number Y into the RAM 102.

After the process of S11, in S12 the controller 100 calculates the deterioration quantity W of the photosensitive drum 50. Specifically, the deterioration quantity W is the sum of: the number obtained by multiplying the first total rotation number X read from the RAM 102 by the first coefficient a; and the number obtained by multiplying the second total rotation number Y read from the RAM 102 by the second coefficient b ($W=aX+bY$).

After performing the process of S12, in S13 the controller 100 determines whether the calculated deterioration quantity W is greater than or equal to the threshold value.

When the controller determines in S13 that the calculated deterioration quantity W is greater than or equal to the threshold value (S13: YES), in S14 the controller 100 determines that the photosensitive drum 50 reaches the end of service life, and then ends the lifetime determination process. On the other hand, when the controller 100 does not determine in S13 that the calculated deterioration quantity W is greater than or equal to the threshold value, i.e., determines that the calculated deterioration quantity W is less than the threshold value (S13: NO), the controller 100 ends the lifetime determination process without determining that the photosensitive drum 50 reaches the end of service life.

According to the first embodiment described above, the first rotation number is stored in the first storage area 98A and the second rotation number is stored in the second storage area 98B of the drum memory 98. Therefore, the number of rotations of the photosensitive drum 50 during the contact state and the number of rotations of the photosensitive drum 50 during the separation state can be separately stored in the drum memory 98.

Hence, with respect to this drum cartridge (drawer 90), the deterioration quantity W of the photosensitive drum 50 can be accurately calculated by using the first rotation number and the second rotation number separately stored in the drum memory 98. Accordingly, the controller 100 in the image forming apparatus 1 employing the above drum cartridge (drawer 90) can perform calculation of the deterioration quantity W of the photosensitive drum 50 based on the first total rotation number X and the second total rotation number Y.

Figure 10:
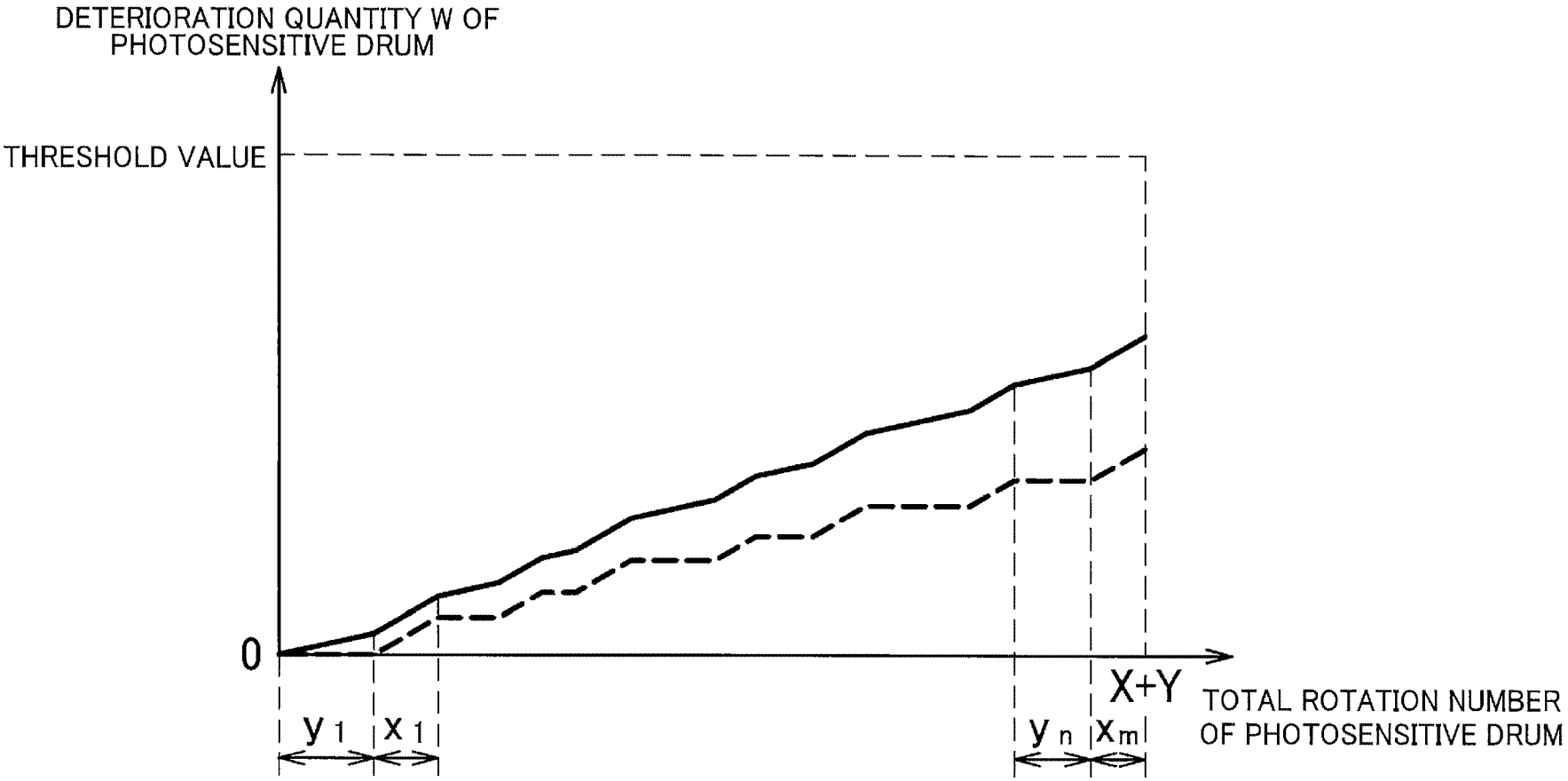
FIG. 10 is a graph showing relationship between the total number of rotations of a photosensitive drum and a deterioration quantity of the photosensitive drum in the image forming apparatus according to the embodiment, in which a solid line indicates changes in the deterioration quantity of the photosensitive drum according to the first embodiment based on calculation, and a broken line indicates changes in a deterioration quantity of the photosensitive drum according to a conventional technique based on calculation.

FIG. 10 is a graph showing the relationship between the total numbers of rotations of the photosensitive drum 50 and the deterioration quantity W of the photosensitive drum 50 calculated by the controller 100. The calculation obtained in the first embodiment is indicated by a solid line, and the calculation obtained in the conventional image forming apparatus is indicated by a broken line in FIG. 10.

According to the conventional image forming apparatus, no consideration was made with respect to the deterioration quantity in the separation state where the developing roller 61 is separated away from the photosensitive drum 50, and the deterioration quantity in the contact state where the developing roller 61 is in contact with the photosensitive drum 50 was only counted.

In contrast, according to the first embodiment, the first rotation number $x_m$ counted in the contact state and the second rotation number $y_n$ counted in the separation state are distinguished when the deterioration quantity W is calculated. Specifically, the second rotation number $y_n$ counted in the separation state is multiplied by the second coefficient b which is smaller than the first coefficient a. Hence, the deterioration quantity W of the photosensitive drum 50 can be calculated with high accuracy.

Second Embodiment

Next, an image forming apparatus according to a second embodiment of the present disclosure will be described with reference to FIGS. 11 through 14.

According to the first embodiment described above, the deterioration quantity W of the photosensitive drum 50 is calculated while taking the state of the photosensitive drum 50 and the developing roller 61 (the contact state or the separation state) into separate consideration.

The second embodiment is different from the first embodiment in that, the deterioration quantity W of the photosensitive drum 50 is calculated using a coefficient corresponding to the temperature of the photosensitive drum 50 while rotating in addition to consideration of the state (the contact state or the separation state) of the photosensitive drum 50 and the developing roller 61. That is, according to the second embodiment, the deterioration quantity W is calculated using a first coefficient $a_m$ and a second coefficient $b_n$ which are changeable depending on the temperature of the photosensitive drum 50 while rotating.

The controller 100 is configured to determine the first coefficient $a_m$ and the second coefficient $b_n$ on the basis of the temperature of the photosensitive drum 50 that is acquired from the temperature sensor TS. The first coefficient $a_m$ and the second coefficient $b_n$ are variable values in accordance with the temperature of the photosensitive drum 50. Depending on the materials of the photosensitive drum 50 and the cleaning roller 53, the first coefficient $a_m$ and the second coefficient $b_n$ may become smaller or may become larger as the temperature of the photosensitive drum 50 acquired from the temperature sensor TS becomes higher.

The following description describes a case where the first coefficient $a_m$ and the second coefficient $b_n$ are determined to smaller values as the temperature of the photosensitive drum 50 acquired from the temperature sensor TS becomes higher. That is, the controller 100 determines the first coefficient $a_m$ and the second coefficient $b_n$ as being smaller values as the temperature of the photosensitive drum 50 acquired from the temperature sensor TS is higher. In other words, the first coefficient $a_m$ and the second coefficient $b_n$ are values determined as smaller values as the temperature of the rotating photosensitive drum 50 is higher in this case.

It is preferable that a map illustrated in FIG. 11 is used to determine the first coefficient $a_m$ and the second coefficient $b_n$. The map indicates coefficients according to the temperature of the photosensitive drum 50 and the state of the photosensitive drum 50 (the contact state or the separation state).

As illustrated in FIG. 11, in the contact state of the photosensitive drum 50, $a_H$ is determined as the first coefficient $a_m$ when the acquired temperature of the photosensitive drum 50 is a high temperature, $a_M$ is determined as the first coefficient $a_m$ when the acquired temperature of the photosensitive drum 50 is a medium temperature, and $a_L$ is determined as the first coefficient $a_m$ when the acquired temperature of the photosensitive drum 50 is a low temperature.

Similarly, in the separation state of the photosensitive drum 50, $b_H$ is determined as the second coefficient $b_n$ when the acquired temperature of the photosensitive drum 50 is a high temperature, $b_M$ is determined as the second coefficient $b_n$ when the acquired temperature of the photosensitive drum 50 is a medium temperature, and $b_L$ is determined as the second coefficient $b_n$ when the acquired temperature of the photosensitive drum 50 is a low temperature.

As one example, the high temperature denotes a temperature higher than or equal to 30° C., the medium temperature denotes a temperature higher than or equal to 10° C. and lower than 30° C., and the low temperature denotes a temperature lower than 10° C. Further, the coefficients in the map of FIG. 11 satisfy the following inequality relationship: $a_H<a_M<a_L$, $b_H<b_M<b_L$, $a_H>b_H$, $a_M>b_M$, and $a_L>b_L$.

As illustrated in FIG. 12, the controller 100 is configured to store the first rotation number $x_m$ during the prescribed period of time and the first coefficient $a_m$ corresponding to the first rotation number $x_m$ into the first storage area 98A of the drum memory 98. In other words, the first storage area 98A is configured to store therein the first coefficient $a_m$ corresponding to the first rotation number $x_m$ in addition to the first rotation number $x_m$.

Similarly, the controller 100 is configured to store the second rotation number $y_n$ and the second coefficient $b_n$ corresponding to the second rotation number $y_n$ into the second storage area 98B of the drum memory 98. In other words, the second storage area 98B is configured to store therein the second coefficient $b_n$ corresponding to the second rotation number $y_n$ in addition to the second rotation number $y_n$.

The controller 100 reads and store all of the first rotation number $x_m$, the first coefficient $a_m$, the second rotation number $y_n$, and the second coefficient $b_n$ into the main memory 110 (for example, the RAM 102). Thereafter, the controller 100 calculates the deterioration quantity W of the photosensitive drum 50 by adding: an accumulation of a value obtained by multiplying the first rotation number $x_m$ by the first coefficient $a_m$ to an accumulation of a value obtained by multiplying the second rotation number $y_n$ by the second coefficient $b_n$ ($W=\Sigma a_m x_m+\Sigma b_n y_n$).

In other words, the deterioration quantity W of the photosensitive drum 50 which is deteriorated due to the rotation of the photosensitive drum 50 is determined by addition of the accumulation of the value obtained by multiplying the first rotation number $x_m$ by the first coefficient $a_m$ to the accumulation of the values obtained by multiplying the second rotation number $y_n$ by the second coefficient $b_n$ smaller than first coefficient $a_m$.

Next, one example of processes performed by the controller 100 in the image forming apparatus according to the second embodiment will be described with reference to a flowchart illustrated in FIG. 13.

Figure 13:
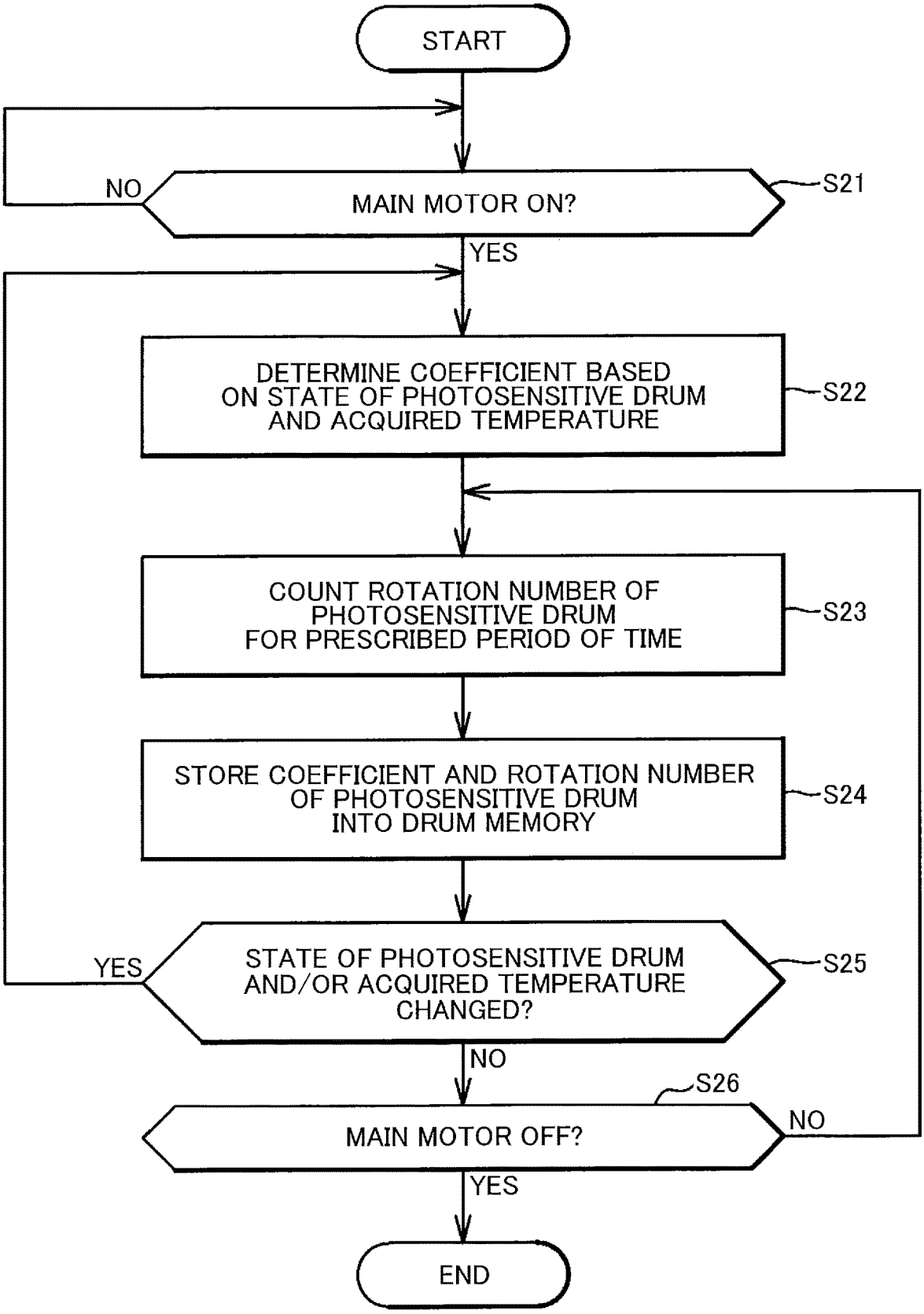
FIG. 13 is a flowchart illustrating a process for storing information in the drum memory performed by a controller in the image forming apparatus according to the second embodiment.

As illustrated in FIG. 13, in S21 the controller 100 determines whether the main motor M1 is turned ON. The controller 100 waits until the main motor M1 is turned ON when the controller 100 determines that the main motor M1 is not turned ON (S21: NO).

When the controller 100 determines in S21 that the main motor M1 is turned ON (S21: YES), in S22 the controller 100 determines the first coefficient $a_m$ or the second coefficient $b_n$ based on the state (the contact state or the separation state) of the photosensitive drum 50 and the acquired temperature of the photosensitive drum 50.

After performing the process of S22, in S23 the controller 100 counts the number of rotations of the photosensitive drum 50 for the prescribed period of time. The number of rotations of the photosensitive drum 50 is the first rotation number $x_m$ or the second rotation number $y_n$ depending on the state of the photosensitive drum 50 (the contact state or the separation state).

After performing the process of S23, in S24 the controller 100 stores the first rotation number $x_m$ and the determined first coefficient $a_m$, or stores the second rotation number $y_n$ and the determined second coefficient $b_n$ into the drum memory 98.

Thereafter, in S25 the controller 100 determines whether at least one of the state of the photosensitive drum 50 (the contact state or the separation state) and acquired temperature of the photosensitive drum 50 changed from a state before the prescribed period of time elapses. Incidentally, "the acquired temperature of the photosensitive drum 50 changed" denotes that the acquired temperature changed from one of the high temperature, the medium temperature, and the low temperature (see FIG. 11) to another of the high temperature, the medium temperature, and the low temperature. That is, in the process of S25, the controller 100 determines whether there is necessity of changing the coefficient.

When the controller 100 determines in S25 that there are changes in at least one of the state of the photosensitive drum 50 and the acquired temperature of the photosensitive drum 50 (S25: YES), the controller 100 shifts to the process of S22. On the other hand, when the controller 100 determines in S25 that there are no changes in the state of the photosensitive drum 50 and the acquired temperature of the photosensitive drum 50 (S25: NO), in S26 the controller 100 determines whether to turn OFF the main motor M1.

When the controller 100 determines not to turn OFF the main motor M1 (S26: NO), the controller 100 shifts to the process of S23. On the other hand, when the controller 100 determines in S26 to turn OFF the main motor M1 (S26: YES), the process is terminated.

Next, one example of a lifetime determination process performed by the controller 100 in the image forming apparatus according to the second embodiment will be described with reference to a flowchart illustrated in FIG. 14.

Figure 14:
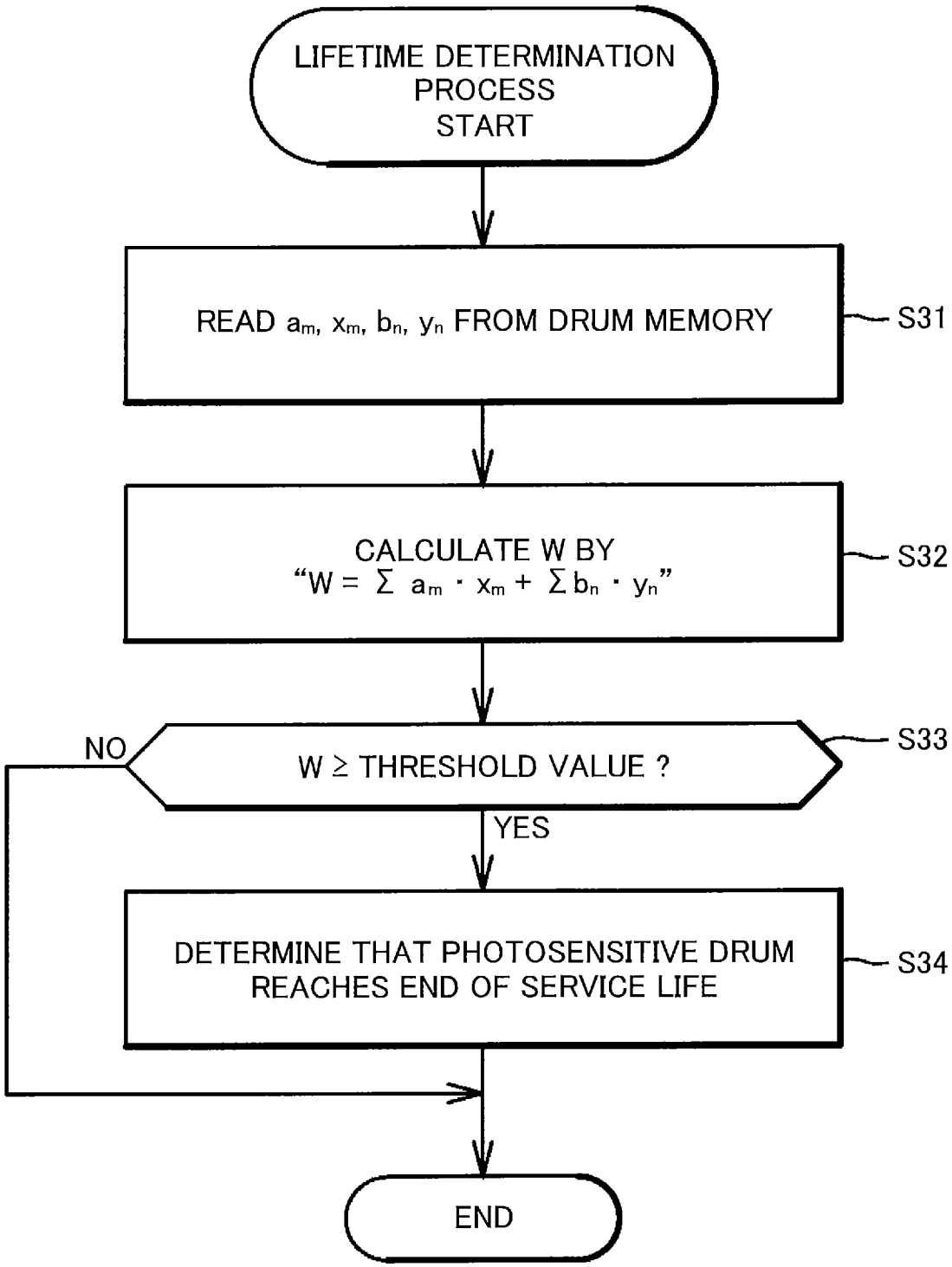
FIG. 14 is a flowchart illustrating a lifetime determination process performed by the controller in the image forming apparatus according to the second embodiment and the third embodiment.

As illustrated in FIG. 14, for performing the lifetime determination process, in S31 the controller 100 reads the first rotation number $x_m$, the first coefficient $a_m$, the second rotation number $y_n$, and the second coefficient $b_n$ from the drum memory 98.

After the process of S31, in S32 the controller 100 calculates the deterioration quantity W of the photosensitive drum 50. Specifically, the deterioration quantity W of the photosensitive drum 50 is calculated by adding the accumulation of the value obtained by multiplying the first rotation number $x_m$ by the first coefficient $a_m$ to the accumulation of the value obtained by multiplying the second rotation number $y_n$ by the second coefficient $b_n$($W=\Sigma a_m x_{m+} \Sigma b_n y_n$).

After performing the process of S32, in S33 the controller 100 determines whether the calculated deterioration quantity W is greater than or equal to the threshold value.

When the controller 100 determines in S33 that the calculated deterioration quantity W is greater than or equal to the threshold value (S33: YES), in S34 the controller 100 determines that the photosensitive drum 50 reaches the end of service life, and ends the life determination process. On the other hand, when the controller 100 determines in S33 that the calculated deterioration quantity W is less than the threshold value (S33: NO), the controller 100 ends the lifetime determination process without determining that the photosensitive drum 50 reaches the end of service life.

According to the second embodiment, the deterioration quantity W of the photosensitive drum 50 is calculated based not only on the state of the photosensitive drum 50 (the contact state or the separation state) but also on the first coefficient $a_m$ corresponding to the first rotation number $x_m$ and the second coefficient $b_n$ corresponding to the second rotation number $y_n$. Therefore, the deterioration quantity W of the photosensitive drum 50 while rotating can be calculated in accordance with the state of the photosensitive drum 50.

Note that the deterioration quantity W of the photosensitive drum 50 due to its rotation varies depending on the temperature of the photosensitive drum 50. Specifically, in a case where the photosensitive drum 50 is more likely to be scraped as the temperature of the photosensitive drum 50 is lower, the deterioration quantity W of the photosensitive drum 50 due to its rotation becomes smaller as the temperature of the photosensitive drum 50 becomes higher.

On the other hand, in a case where the photosensitive drum 50 is more likely to be scraped as the temperature of the photosensitive drum 50 is higher, the deterioration quantity W of the photosensitive drum 50 due to its rotation becomes larger as the temperature of the photosensitive drum 50 becomes higher.

Here, the relationship between the temperature of the photosensitive drum 50 and the likelihood of scrape of the photosensitive drum 50 varies depending on materials of the photosensitive drum 50 and the cleaning roller 53. To this effect, according to the second embodiment, the deterioration quantity W is calculated on the basis of the state of the photosensitive drum 50 as well as the temperature of the photosensitive drum 50 during the rotation. Accordingly, the deterioration quantity W of the photosensitive drum 50 can be calculated accurately.

Third Embodiment

An image forming apparatus according to a third embodiment of the present disclosure will next be described with reference to FIGS. 12 and 14 through 16.

According to the second embodiment, the deterioration quantity W of the photosensitive drum 50 is calculated using the coefficient corresponding to the temperature of the photosensitive drum 50 in addition to consideration of the state of the photosensitive drum 50. According to the third embodiment, the deterioration quantity W of the photosensitive drum 50 is calculated using a coefficient determined depending on a total rotation number Z of the photosensitive drum 50 in addition to the state of the photosensitive drum 50 and the temperature of the photosensitive drum 50.

The total rotation number Z of the photosensitive drum 50 is a sum of the first total rotation number X and the second total rotation number Y (Z=X+Y). In a case where the total rotation number Z is zero (Z=0), the photosensitive drum 50 is a new product. The photosensitive drum 50 approaches the end of the service life as the total rotation number Z increases.

Specifically, the controller 100 determines the first coefficient $a_m$ and the second coefficient $b_n$ so that these first coefficient $a_m$ and second coefficient $b_n$ become larger values as the total rotation number Z of the photosensitive drum 50 from the new state increases. In other words, the first coefficient $a_m$ and the second coefficient $b_n$ are values determined to become larger values as the total rotation number Z of the photosensitive drum 50 from the new state increases.

It is preferable that a map illustrated in FIG. 15 is used to determine the first coefficient $a_m$ and the second coefficient $b_n$, for example. Specifically, as illustrated in FIG. 15, in a state where the photosensitive drum 50 and the developing roller 61 are in the contact state and the total rotation number Z is low: $a_{HS}$ is determined as the first coefficient $a_m$ when the acquired temperature of the photosensitive drum 50 is the high temperature; $a_{MS}$ is determined as the first coefficient $a_m$ when the acquired temperature of the photosensitive drum 50 is the medium temperature; and $a_{LS}$ is determined as the first coefficient $a_m$ when the acquired temperature of the photosensitive drum 50 is the low temperature.

Further, in a state where the photosensitive drum 50 and the developing roller 61 are in the contact state and the total rotation number Z is medium: $a_{HF}$ is determined as the first coefficient $a_m$ when the acquired temperature of the photosensitive drum 50 is the high temperature, $a_{MF}$ is determined as the first coefficient $a_m$ when the acquired temperature of the photosensitive drum 50 is the medium temperature; and $a_{LF}$ is determined as the first coefficient $a_m$ when the acquired temperature of the photosensitive drum 50 is the low temperature.

Further, in a state where the photosensitive drum 50 and the developing roller 61 are in the contact state and the total rotation number Z is high: $a_{HO}$ is determined as the first coefficient $a_m$ when the acquired temperature of the photosensitive drum 50 is the high temperature; $a_{MO}$ is determined as the first coefficient $a_m$ when the acquired temperature of the photosensitive drum 50 is the medium temperature; and $a_{LO}$ is determined as the first coefficient $a_m$ when the acquired temperature of the photosensitive drum 50 is the low temperature.

Similarly, in a state where the photosensitive drum 50 and the developing roller 61 are in the separation state and the total rotation number Z is low: $b_{HS}$ is determined as the second coefficient $b_n$ when the acquired temperature of the photosensitive drum 50 is the high temperature, $b_{MS}$ is determined as the second coefficient $b_n$ when the acquired temperature of the photosensitive drum 50 is the medium temperature; and $b_{LS}$ is determined as the second coefficient $b_n$ when the acquired temperature of the photosensitive drum 50 is the low temperature.

Further, in a state where the photosensitive drum 50 and the developing roller 61 are in the separation state and the total rotation number Z is medium: $b_{HF}$ is determined as the second coefficient $b_n$ when the acquired temperature of the photosensitive drum 50 is the high temperature; $b_{MF}$ is determined as the second coefficient $b_n$ when the acquired temperature of the photosensitive drum 50 is the medium temperature; and $b_{LF}$ is determined as the second coefficient $b_n$ when the acquired temperature of the photosensitive drum 50 is the low temperature.

Further, in a state where the photosensitive drum 50 and the developing roller 61 are in the separation state and the total rotation number Z is high: $b_{HO}$ is determined as the second coefficient $b_n$ when the acquired temperature of the photosensitive drum 50 is the high temperature; $b_{MO}$ is determined as the second coefficient $b_n$ when the acquired temperature of the photosensitive drum 50 is the medium temperature; and $b_{LO}$ is determined as the second coefficient $b_n$ when the acquired temperature of the photosensitive drum 50 is the low temperature.

In one example, "the total rotation number Z is low" denotes that the total rotation number Z is in a range of from the photosensitive drum 50 is a new product (i.e., the number of rotations is 0 (zero)) to the rotation number of less than 10,000, "the total rotation number Z is middle" denotes that the total rotation number Z is in a range within greater than or equal to 10,000 and less than 20,000, and "the total rotation number Z is high" denotes that the total rotation number Z is not less than 20,000. Further, these coefficients in the map of FIG. 15 satisfy the following relationship: $a_{HS}<a_{MS}<a_{LS}$, $a_{HF}<a_{MF}<a_{LF}$, $a_{HO}<a_{MO}<a_{LO}$, $a_{HS}<a_{HF}<a_{HO}$, $a_{MS}<a_{MF}<a_{MO}$, $a_{LS}<a_{LF}<a_{LO}$, $b_{HS}<b_{MS}<b_{LS}$, $b_{HF}<b_{MF}<b_{LF}$, $b_{HO}<b_{MO}<b_{LO}$, $b_{HS}<b_{HF}<b_{HO}$, $b_{MS}<b_{MF}<b_{MO}$, and $b_{LS}<b_{LF}<b_{LO}$.

Next, one example of processes performed by the controller 100 in the image forming apparatus according to the third embodiment will be described with reference to a flowchart illustrated in FIG. 16.

Figure 16:
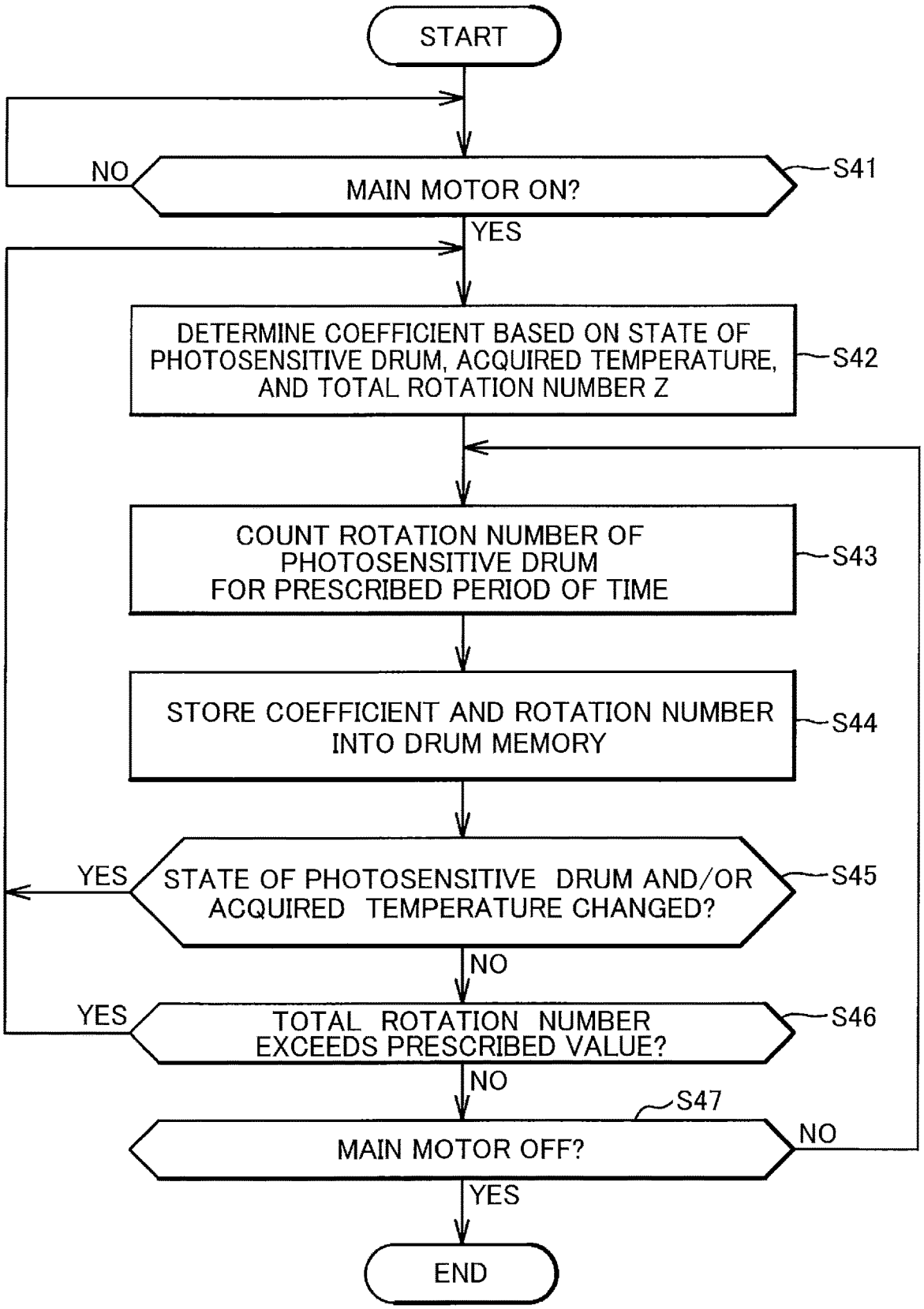
FIG. 16 is a flowchart illustrating a process for storing information in a drum memory performed by the controller in the image forming apparatus according to the third embodiment.

As illustrated in FIG. 16, in S41 the controller 100 determines whether the main motor M1 is turned ON. The controller 100 waits until the main motor M1 is turned ON when the controller 100 determines that the main motor M1 is not turned ON (S41: NO).

When the controller 100 determines in S41 that the main motor M1 is turned ON (S41: YES), in S42 the controller 100 determines the first coefficient $a_m$ or the second coefficient $b_n$ in accordance with the state of the photosensitive drum 50 and the developing roller 61 (the contact state or the separation state), the acquired temperature of the photosensitive drum 50, and the total rotation number Z of the photosensitive drum 50 referring to the map of FIG. 15.

After performing the process of S42, in S43 the controller 100 counts the rotation number of the photosensitive drum 50 for the prescribed period of time. The rotation number is the first rotation number $x_m$ or the second rotation number $y_n$ depending on state of the photosensitive drum 50 and the developing roller 61 (the contact state or the separation state).

After the process of S43, in S44 the controller 100 stores the first rotation number $x_m$ and the determined first coefficient $a_m$ or stores the second rotation number $y_n$ and the determined second coefficient $b_n$ into the drum memory 98.

After performing the process of S44, in S45 the controller 100 determines whether at least one of the state of the photosensitive drum 50 and the acquired temperature of the photosensitive drum 50 changes from a state before the prescribed period of time elapses. Incidentally, "the acquired temperature of the photosensitive drum 50 changed" denotes that the acquired temperature changed from one of the high temperature, the medium temperature, and the low temperature (see FIG. 11) to another of the high temperature, the medium temperature, and the low temperature. That is, in the process of S45, the controller 100 determines whether there is necessity of changing the coefficient.

When the controller 100 determines in S45 that at least one of the state of the photosensitive drum 50 and the acquired temperature of the photosensitive drum 50 changes (S45: YES), the controller 100 shifts to the process of S42.

On the other hand, when the controller 100 determines that there are no changes in the state of the photosensitive drum 50 and the acquired temperature of the photosensitive drum 50 (S45: NO), in S46 the controller 100 determines whether the total rotation number Z exceeds a prescribed value. When the total rotation number Z becomes from the low to the medium, or when the total rotation number Z becomes from the medium to the high (see FIG. 15), the controller 100 determines that the total rotation number Z exceeds the prescribed value. That is, in the process of S46, the controller 100 also determines whether there is necessity of changing the coefficient.

When the controller 100 determines in S46 that the total rotation number Z exceeds the prescribed value (S46: YES), the controller 100 shifts to the process in S42. On the other hand, when the controller 100 determines in S46 that the total rotation number Z does not exceed the prescribed value (S46: NO), in S47 the controller 100 determines whether the main motor M1 needs to be turned OFF.

When the controller 100 determines in S47 not to turn OFF the main motor M1 (S47: NO), the controller 100 shifts to the process of S43. On the other hand, when the controller 100 determines in S47 to turn OFF the main motor M1 (S47: YES), the controller 100 ends the process.

Note that a lifetime determination process performed by the controller 100 in the image forming apparatus according to the third embodiment is the same as that performed in the second embodiment (see FIG. 14).

According to the third embodiment, the controller 100 calculates the deterioration quantity W of the photosensitive drum 50 based on the total rotation number Z of the photosensitive drum 50 as well as the state of the photosensitive drum 50 and the developing roller 61 (the contact state or the separation state) and the temperature of the photosensitive drum 50, thereby realizing accurate calculation of the deterioration quantity of the photosensitive drum 50.

Fourth Embodiment

Next, an image forming apparatus according to a fourth embodiment of the present disclosure will next be described with reference to FIGS. 17 and 18.

According to the first embodiment, the controller 100 stores the first total rotation number X and the second total rotation number Y of the photosensitive drum 50 into the drum memory 98. The fourth embodiment is different from the first embodiment in that the controller 100 stores the deterioration quantity W of the photosensitive drum 50 into the drum memory 98.

Specifically, the controller 100 is configured to store the deterioration quantity W of the photosensitive drum 50 into the drum memory 98. When the photosensitive drum 50 is a new product, the deterioration quantity W is zero (W=0).

When the controller 100 causes the photosensitive drum 50 to rotate for a prescribed period of time, the controller 100 counts a rotation number $z_n$ of the photosensitive drum 50 in the prescribed period of time. Further, the controller 100 determines a coefficient an in accordance with the state of the photosensitive drum 50 (the contact state or the separation state), the acquired temperature of the photosensitive drum 50, and the total rotation number Z of the photosensitive drum 50 at a time of counting the rotation number $z_n$. The coefficient $\alpha_n$ is the first coefficient $a_m$ or the second coefficient $b_n$ depending on the state of the photosensitive drum 50. The map illustrated in FIG. 15 is used for determining the coefficient $\alpha_n$ in a manner the same as the third embodiment. Note that coefficient other than that employed in the third embodiment (i.e., the coefficient employed in the first and second embodiments described above) may be used to determine the coefficient $\alpha_n$ in the present embodiment.

When the controller 100 controls the photosensitive drum 50 to rotate, the controller 100 stores an updated deterioration quantity W by adding a value obtained by multiplying the rotation number $z_n$ by the coefficient $\alpha_n$ to the current deterioration quantity W.

Next, one example of processes performed by the controller 100 in the image forming apparatus according to the fourth embodiment will be described with reference to a flowchart illustrated in FIG. 17.

Figure 17:
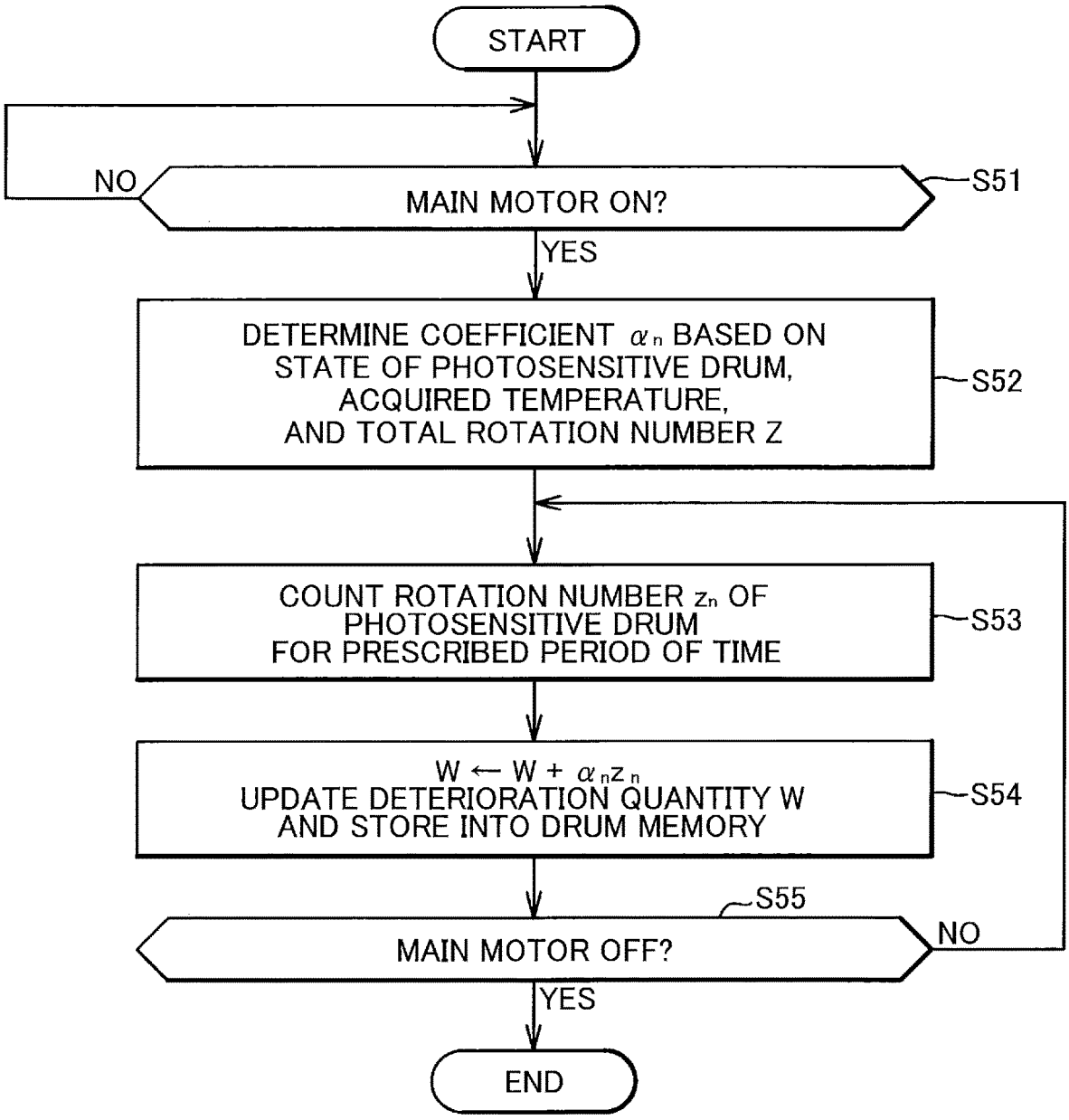
FIG. 17 is a flowchart illustrating a process for storing information in a drum memory performed by a controller in an image forming apparatus according to a fourth embodiment of the present disclosure.

As illustrated in FIG. 17, in S51 the controller 100 determines whether the main motor M1 is turned ON. The controller 100 waits until the main motor M1 is turned ON when the controller 100 determines in S51 that the main motor M1 is not turned ON (S51: NO).

When the controller 100 determines in S51 that the main motor M1 is turned ON (S51: YES), in S52 the controller 100 determines the coefficient $\alpha_n$ in accordance with the state of the photosensitive drum 50 (the contact state or the separation state), the acquired temperature of the photosensitive drum 50, and the total rotation number Z of the photosensitive drum 50.

After performing the process of S52, in S53 the controller 100 counts the rotation number $z_n$ of the photosensitive drum 50 for the prescribed period of time.

After performing the process of S53, the controller 100 updates the deterioration quantity W by adding a value obtained by multiplying the rotation number $z_n$ by the coefficient an to the deterioration quantity W of the photosensitive drum 50 already stored in the drum memory 98, and stores the updated deterioration quantity W into the drum memory 98 ($W \leftarrow W+\alpha_n z_n$).

After performing the process of S4, in S55 the controller 100 determines whether the main motor M1 should be turned OFF.

When the controller 100 does not determine in S55 that the maim motor M1 should be turned ON (S55: NO), the controller 100 shifts to the process of S53. On the other hand, when the controller 100 determines in S55 that the main motor M1 should be turned OFF (S55: YES), the process is ended.

Next, a lifetime determination process performed by the controller 100 in the image forming apparatus according to the fourth embodiment will be described with reference to a flowchart illustrated in FIG. 18.

Figure 18:
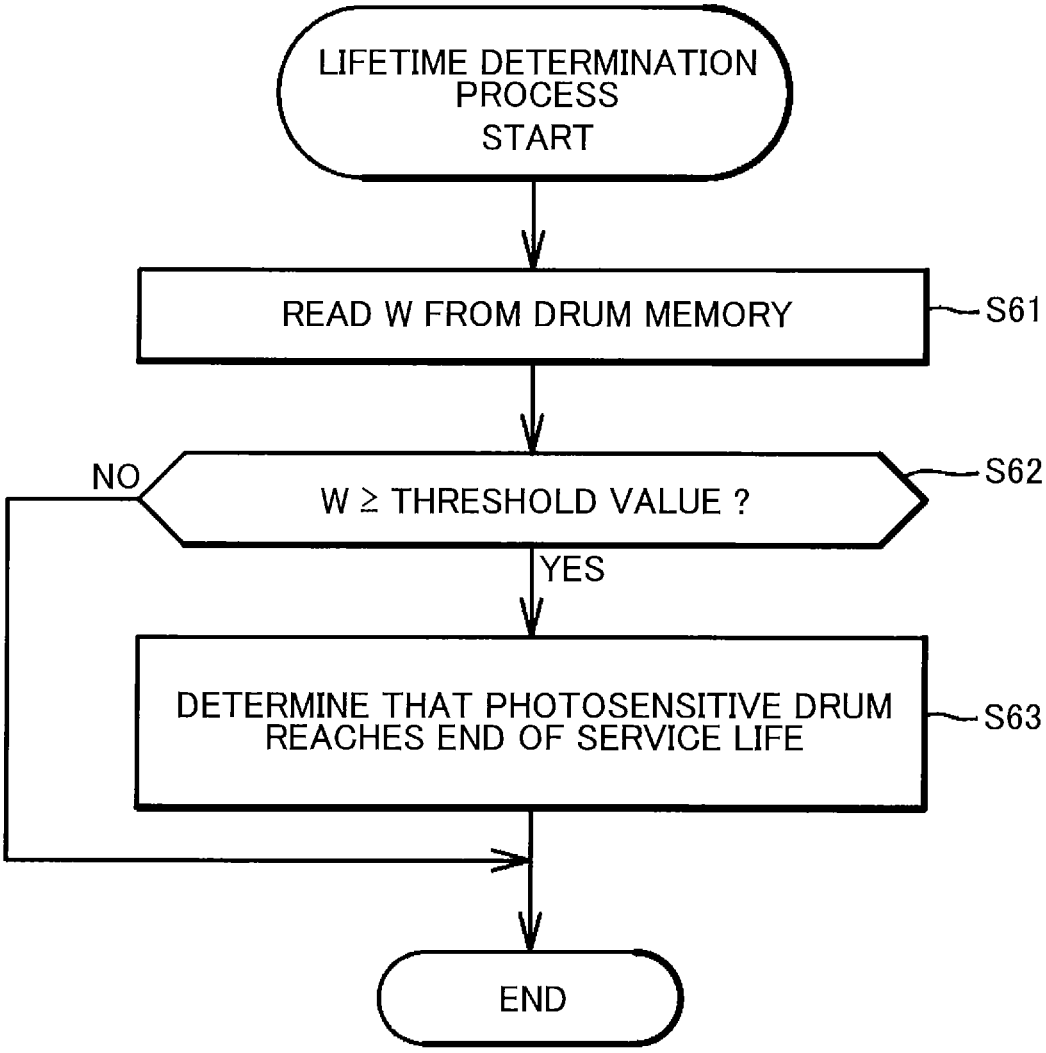
FIG. 18 is a flowchart illustrating a lifetime determination process performed by the controller in the image forming apparatus according to the fourth embodiment.

As illustrated in FIG. 18, for performing the lifetime determination process, in S61 the controller 100 reads the deterioration quantity W from the drum memory 98.

After performing the process of S61, in S62 the controller 100 determines whether the read deterioration quantity W is greater than or equal to the threshold value.

When the controller 100 determines in S62 that the deterioration quantity W is equal to or greater than the threshold value (S62: YES), in S63 the controller 100 determines that the photosensitive drum 50 reaches the end of service life, and the life determination process is ended. On the other hand, when the controller 100 determines in S62 that the deterioration quantity W is less than the threshold value (S62: NO), the controller 100 determines that the photosensitive drum 50 does not reach the end of service life, and ends the life determination process.

According to the fourth embodiment, since the deterioration quantity W of the photosensitive drum 50 calculated based the number of rotations of the photosensitive drum 50 in the contact state (the first rotation number $x_m$) and the number of rotations of the photosensitive drum 50 in the separation state (the second rotation number $y_n$) are stored in the drum memory 98, the deterioration quantity W of the photosensitive drum 50 can be calculated with high accuracy.

Further, not only the state of the photosensitive drum 50 and the temperature of the photosensitive drum 50 but also the total rotation number Z of the photosensitive drum 50 are considered for the calculation of the deterioration quantity W by the controller 100. Therefore, the controller 100 can more accurately calculate the deterioration quantity W of the photosensitive drum 50.

Modifications

While the description has been made with reference to the embodiments, it would be apparent to those skilled in the art that the present disclosure need not be limited to the above-described embodiments and various modifications can be made thereto.

For example, according to the second through fourth embodiments described above, the map showing the coefficients corresponding to the state of the photosensitive drum 50 is used to determine the first coefficient $a_m$ and the second coefficient $b_n$. However, these coefficients may be determined by a formula instead of the map.

Specifically, when the photosensitive drum 50 and the developing roller 61 are in the contact state, the coefficient an may be obtained by adding a value obtained by multiplying a first correction factor $c_1$ by the total rotation number Z to a first constant $a_0$($\alpha_n=a_0+c_1Z$). In the same way, when the photosensitive drum 50 is in the separation state, the coefficient $\alpha_n$ may be obtained by adding a value obtained by multiplying a second correction factor $c_2$ by the total rotation number Z to a second constant $b_0$($\alpha_n=b_0+c_2Z$). The first correction factor $c_1$ and the second correction factor $c_2$ are positive values.

The controller 100 may also calculate the deterioration quantity W of the photosensitive drum 50 by an accumulation of a value obtained by multiplying the rotation number $z_n$ during the prescribed period of time by the coefficient $\alpha_n$($W=\Sigma\alpha_n z_n$).

Alternatively, the controller 100 may store the deterioration quantity W in the drum memory 98, and may calculate an updated deterioration quantity W by adding a value obtained by multiplying the rotation number $z_n$ by the coefficient an corresponding to the rotation number $z_n$ to the already stored deterioration quantity W, and may store the updated deterioration quantity W into the drum memory 98 when rotating the photosensitive drum 50.

Further, in the above-described embodiments, the map having three temperature sections including a section for the high temperature, a section for the medium temperature, and a section for the low temperature is used for determining the coefficient. However, a map having two temperature sections or not less than four temperature sections may be employed.

Further, in the above-described embodiments, the map having three sections for the total rotation number Z including a section for the low rotation number, a section for the medium rotation number, and a section for the high rotation number is used for determining the coefficient. However, a map having two sections or not less than four sections for the total rotation number Z may be used.

Further, in the above-described embodiments, the state of the photosensitive drum 50 and the developing roller 61 (the contact state or the separation state), the temperature of the photosensitive drum 50, and the total rotation number Z of the photosensitive drum 50 are used for determining the coefficient. However, factors other than the above factors may be employed.

For example, in a case where the image forming apparatus 1 includes cleaning rollers each movable between a contact position where the cleaning roller is in contact with a corresponding photosensitive drum 50 and a separated position where the cleaning roller is in separation from the corresponding photosensitive drum 50, the coefficient may be determined based on the state (the contact state or the separation state) of the cleaning roller.

Further, in a case where the image forming apparatus 1 includes charge rollers instead of the chargers 52 and each of the charge roller is movable between a contact position where the charge roller is in contact with a corresponding photosensitive drum 50 and a separated position where the charge roller is in separation from the corresponding photosensitive drum 50, the coefficient may be determined based on the state (the contact state or the separation state) of the charge roller.

Further, in the above-described embodiment, each of the separation mechanisms RK performs the switching of the state of the photosensitive drum 50 and the developing roller 61 between contact state and the separation state by moving the developing roller 61. However, the separation mechanism RK may perform the switching of the state of the photosensitive drum 50 and the developing roller 61 between contact state and the separation state by moving the photosensitive drum 50 or by moving both the developing roller 61 and the photosensitive drum 50.

Further, according to the above third embodiment, the deterioration quantity W of the photosensitive drum 50 is calculated using the temperature of the photosensitive drum 50 and the coefficient corresponding to the total rotation number Z of the photosensitive drum 50. However, the deterioration quantity W of the photosensitive drum 50 may be calculated without depending on the temperature of the photosensitive drum 50 but using the coefficient depending on the total rotation number Z of the photosensitive drum 50.

Further, in the above-described embodiments, a motor for driving the photosensitive drums 50 and a motor for driving the developing rollers 61 are separately provided. However, one single motor may be provided to drive both the photosensitive drums 50 and the developing rollers 61.

Further, in the above-described embodiments, the drum cartridge is the drawer 90 configured to be pulled out of the main casing 10, and includes the four photosensitive drums 50 and the four developing cartridges 60 detachable from and attachable to the drum cartridge. However, other configurations may be available.

For example, the drum cartridge may not include the plurality of developing cartridges 60 and the plurality of photosensitive drums 50, but may include one single developing cartridge and one single photosensitive drum.

Further, in the above-described embodiments, the drum cartridge is attachable to and detachable from the main casing in a horizontal direction. However, the drum cartridge may be attachable to and detachable from the main casing 10 from above, or in a diagonal direction.

Further, in the above-described embodiments, the drum cartridge allows the developing cartridge including the developing roller to be attachable thereto and detachable therefrom. However, a drum cartridge may be configured to allow a toner cartridge that does not include a developing roller to be attachable thereto and detachable therefrom. In the latter case, the drum cartridge may include the developing roller and the photosensitive drum, and the toner cartridge may not include the developing roller but include a toner accommodating portion for accommodating therein toner.

Further, in the above-described embodiments, the developing cartridge 60 is attachable to and detachable from the drum cartridge, and the drum cartridge to which the developing cartridge 60 is attached is attachable to and detachable from the main casing 10. However, the developing cartridge 60 and the drum cartridge may be attachable to and detachable from the main casing 10 independent from each other. Further, a drum cartridge in which a developing cartridge is integrally formed with the drum cartridge so as not to be detachable from the drum cartridge may be attachable to and detachable from the main casing 10. In the latter case, the drum cartridge may include a toner accommodating portion for accommodating therein toner, a developing roller, and a photosensitive drum.

Further, in the above-described embodiments, the image forming apparatus 1 is a color printer for forming a color image using toners of four colors. However, the image forming apparatus 1 may be a monochromatic printer, or a color printer that forms a color image using toners of three colors or more than five colors.

Further, the image forming apparatus 1 may be a multifunction peripheral or a copying machine.

Further, components and processes appearing in the embodiments and modifications described above may be suitably selected and combined as long as any conflicting combination is avoided.

What is claimed is:

1. An image forming apparatus comprising:

a photosensitive drum rotatable about a first axis extending in an axial direction;

a developing roller rotatable about a second axis extending in the axial direction;

a separation mechanism configured to move at least one of the photosensitive drum and the developing roller to switch a state of the photosensitive drum and the developing roller between:

a contact state in which an outer circumferential surface of the developing roller is in contact with an outer circumferential surface of the photosensitive drum; and a separation state in which the outer circumferential surface of the developing roller is in separation from the outer circumferential surface of the photosensitive drum;

a main memory configured to store therein a first rotation number and a second rotation number, the first rotation number being the number of rotations of the photosensitive drum in the contact state of the photosensitive drum and the developing roller, the second rotation number being the number of rotations of the photosensitive drum in the separation state of the photosensitive drum and the developing roller; and a controller configured to perform:

calculating a deterioration quantity of the photosensitive drum based on the first rotation number and the second rotation number those stored in the main memory.

2. The image forming apparatus according to claim 1, wherein, in the calculating, the controller calculates the deterioration quantity by adding a value obtained by multiplying a first total rotation number by a first coefficient to a value obtained by multiplying a total second rotation number by a second coefficient smaller than the first coefficient, the first total rotation number being an accumulation of the first rotation number since the photosensitive drum is new, the second total rotation number being an accumulation of the second rotation number since the photosensitive drum is new.

3. The image forming apparatus according to claim 2, wherein the controller is configured to further perform:

determining the first coefficient and the second coefficient so that the first coefficient and the second coefficient become larger values as a total rotation number becomes larger, the total rotation number being an accumulation of the number of rotations of the photosensitive drum since the photosensitive drum is new.

4. The image forming apparatus according to claim 1, further comprising:

a main casing; and a drum cartridge attachable to and detachable from the main casing, the drum cartridge comprising:

the photosensitive drum; and a drum memory, wherein the controller is configured to further perform:

storing, into the drum memory, the first rotation number and the second rotation number.

5. The image forming apparatus according to claim 1, further comprising:

a main casing; and a drum cartridge attachable to and detachable from the main casing, the drum cartridge comprising:

the photosensitive drum; and a drum memory, wherein the controller is configured to further perform:

storing, into the drum memory, the deterioration quantity of the photosensitive drum.

6. The image forming apparatus according to claim 1, further comprising:

a main casing; and a drum cartridge attachable to and detachable from the main casing, the drum cartridge comprising:

the photosensitive drum; and a drum memory, wherein the controller is configured to further perform:

storing, into the drum memory, the first rotation number and a first coefficient corresponding to the first rotation number;

storing, into the drum memory, the second rotation number and a second coefficient corresponding to the second rotation number, the second coefficient being smaller than the first coefficient; and reading, from the drum memory, all of the first rotation number, the first coefficient, the second rotation number, and the second coefficient, and wherein, in the calculating, the controller calculates the deterioration quantity by adding an accumulation value which is an accumulation of a value obtained by multiplying the first rotation number and the corresponding first coefficient to an accumulation value which is an accumulation of a value obtained by multiplying the second rotation number and the corresponding second coefficient.

7. The image forming apparatus according to claim 6, further comprising a temperature sensor configured to detect a temperature of the photosensitive drum, wherein the controller is configured to further perform:

determining the first coefficient and the second coefficient based on the temperature of the photosensitive drum acquired from the temperature sensor.

8. The image forming apparatus according to claim 1, further comprising:

a main casing; and a drum cartridge attachable to and detachable from the main casing, the drum cartridge comprising:

the photosensitive drum; and a drum memory, wherein the controller is configured to further perform:

storing, into the drum memory, the deterioration quantity of the photosensitive drum;

in a case where the photosensitive drum rotates in the contact state of the photosensitive drum and the developing roller, updating the deterioration quantity of the photosensitive drum in the drum memory by adding a value obtained by multiplying the first rotation number by a first coefficient corresponding to the first rotation number to the deterioration quantity stored in the drum memory; and in a case where the photosensitive drum rotates in the separation state of the photosensitive drum and the developing roller are in the separation state, updating the deterioration quantity of the photosensitive drum in the drum memory by adding a value obtained by multiplying the second rotation number by a second coefficient corresponding to the second rotation number to the deterioration quantity stored in the drum memory, the second coefficient being smaller than the first coefficient.

9. The image forming apparatus according to claim 1, wherein the controller is configured to further perform:

when the deterioration quantity of the photosensitive drum reaches a threshold value, determining that the photosensitive drum reaches an end of service life.

10. The image forming apparatus according to claim 1, wherein the controller is configured to further perform:

calculating a remaining service life of the photosensitive drum by subtracting the deterioration quantity of the photosensitive drum from a value indicative of an entire service life of the photosensitive drum.

11. A drum cartridge comprising:

a photosensitive drum rotatable about a first axis extending in an axial direction, the photosensitive drum being switchable between:

a contact state in which an outer circumferential surface of the photosensitive drum is in contact with an outer circumferential surface of a developing roller; and a separation state in which the outer circumferential surface of the photosensitive drum is in separation from the outer circumferential surface of the developing roller; and a drum memory including:

a first storage area configured to store therein a first rotation number which is the number of rotations of the photosensitive drum in the contact state of the photosensitive drum; and a second storage area configured to store therein a second rotation number which is the number of rotations of the photosensitive drum in the separation state of the photosensitive drum.

12. The drum cartridge according to claim 11, wherein the first storage area is configured to store therein a first total rotation number as the first rotation number, the first total rotation number being an accumulation of the number of rotations of the photosensitive drum in the contact state of the photosensitive drum since the photosensitive drum is new, and wherein the second storage area is configured to store therein a second total rotation number as the second rotation number, the second total rotation number being an accumulation of the number of rotations of the photosensitive drum in the separation state of the photosensitive drum since the photosensitive drum is new.

13. The drum cartridge according to claim 12, wherein a deterioration quantity of the photosensitive drum is determined based on the first total rotation number and the second total rotation number, the deterioration quantity indicating a quantity by which the photosensitive drum is deteriorated due to rotation of the photosensitive drum.

14. The drum cartridge according to claim 13, wherein the deterioration quantity of the photosensitive drum is determined by adding a value obtained by multiplying the first total rotation number by a first coefficient to a value obtained by multiplying the second total rotation number by a second coefficient smaller than the first coefficient.

15. The drum cartridge according to claim 14, wherein the first coefficient and the second coefficient changes based on a temperature of the photosensitive drum when the photosensitive drum rotates.

16. The drum cartridge according to claim 14, wherein the first coefficient and the second coefficient are values become larger as a total rotation number becomes larger, the total rotation number being an accumulation of the number of rotations of photosensitive drum since the photosensitive drum is new.

17. The drum cartridge according to claim 11, wherein the first storage area is further configured to store therein a first coefficient corresponding to the first rotation number, and wherein the second storage area is further configured to store therein a second coefficient corresponding to the second rotation number, the second coefficient being smaller than the first coefficient.

18. The drum cartridge according to claim 17, wherein a deterioration quantity of the photosensitive drum is determined by adding an accumulation value which is an accumulation of a value obtained by multiplying the first rotation number by the first coefficient to an accumulation value which is an accumulation of a value obtained by multiplying the second rotation number by the second coefficient, the deterioration quantity indicating a quantity by which the photosensitive drum is deteriorated due to rotation of the photosensitive drum.

19. The drum cartridge according to claim 11, wherein the drum cartridge is for use with a developing cartridge including the developing roller, the developing cartridge being attachable to and detachable from the drum cartridge.

20. The drum cartridge according to claim 11, further comprising a separation mechanism configured to switch a state of the photosensitive drum between the contact state and the separation state.

21. The drum cartridge according to claim 11, further comprising another photosensitive drum, wherein the drum cartridge is a drawer that can be pulled out of a main casing of an image forming apparatus.

22. A drum cartridge comprising:

a photosensitive drum rotatable about a first axis extending in an axial direction, the photosensitive drum being switchable between:

a contact state in which an outer circumferential surface of the photosensitive drum is in contact with an outer circumferential surface of a developing roller; and a separation state in which the outer circumferential surface of the photosensitive drum is in separation from the outer circumferential surface of the developing roller; and a drum memory configured to store therein a deterioration quantity of the photosensitive drum which is deteriorated due to rotation of the photosensitive drum, the deterioration quantity being determined based on a first rotation number and a second rotation number, the first rotation number being the number of rotations of the photosensitive drum in the contact state of the photosensitive drum, the second rotation number being the number of rotations of the photosensitive drum in the separation state of the photosensitive drum.

23. The drum cartridge according to claim 22, wherein the deterioration quantity of the photosensitive drum is determined by adding a value obtained by multiplying a first total rotation number by a first coefficient to a value obtained by multiplying a second total rotation number by a second coefficient smaller than the first coefficient, the first total rotation number being an accumulation of the number of rotations of the photosensitive drum in the contact state of the photosensitive drum since the photosensitive drum is new, the second total rotation number being an accumulation of the number of rotations of the photosensitive drum in the separation state of the photosensitive drum since the photosensitive drum is new.

24. The drum cartridge according to claim 23, wherein the first coefficient and the second coefficient are values determined to be smaller as a temperature of the photosensitive drum is higher.

25. The drum cartridge according to claim 23, wherein the first coefficient and the second coefficient are values determined to be larger as a total rotation number becomes larger, the total rotation number being an accumulation of the number of rotations of photosensitive drum since the photosensitive drum is new.

26. The drum cartridge according to claim 22, wherein the deterioration quantity of the photosensitive drum is determined by adding an accumulation value which is an accumulation of a value obtained by multiplying the first rotation number by a first coefficient corresponding to the first rotation number to an accumulation value which is an accumulation of a value obtained by multiplying the second rotation number by a second coefficient corresponding to the second rotation number, the second coefficient being smaller than the first coefficient.

27. The drum cartridge according to claim 22, wherein the drum cartridge is for use with a developing cartridge including the developing roller, the developing cartridge being attachable to and detachable from the drum cartridge.

28. The drum cartridge according to claim 22, further comprising a separation mechanism configured to switch a state of the photosensitive drum between the contact state and the separation state.

29. The drum cartridge according to claim 22, further comprising another photosensitive drum, wherein the drum cartridge is a drawer that can be pulled out of a main casing of an image forming apparatus.

* * * * *